US007676137B2

(12) United States Patent
Schick et al.

(10) Patent No.: US 7,676,137 B2
(45) Date of Patent: Mar. 9, 2010

(54) OPTICAL SIGHT

(75) Inventors: Darin W. Schick, Livonia, MI (US); Newton Quan-Chung Kwan, Bellevue, WA (US); Timothy H. Miller, Ann Arbor, MI (US); Jerry Glen S. Elpedes, Milford, MI (US)

(73) Assignee: Trijicon, Inc., Wixom, MI (US)

( * ) Notice: Subject to any disclaimer, the term of this patent is extended or adjusted under 35 U.S.C. 154(b) by 0 days.

(21) Appl. No.: 12/125,367

(22) Filed: May 22, 2008

(65) Prior Publication Data

US 2009/0100735 A1 Apr. 23, 2009

Related U.S. Application Data

(60) Provisional application No. 60/939,483, filed on May 22, 2007.

(51) Int. Cl.

| | |
|---|---|
| ***G02B 6/00*** | (2006.01) |
| ***F41G 1/00*** | (2006.01) |
| ***F41G 1/38*** | (2006.01) |
| ***F41G 1/42*** | (2006.01) |

(52) U.S. Cl. ..... 385/147; 42/111; 42/132; 33/297; 33/298; 385/134

(58) Field of Classification Search ..... 42/132; 250/467.1; 33/297, 298; 385/147
See application file for complete search history.

(56) References Cited

U.S. PATENT DOCUMENTS

| | | | | |
|---|---|---|---|---|
| 3,230,627 | A | 1/1966 | Rickert et al. | |
| 3,672,782 | A | 6/1972 | Akin, Jr. | |
| 4,383,288 | A | 5/1983 | Hess, II et al. | |
| 4,531,052 | A | 7/1985 | Moore | |
| 4,554,744 | A * | 11/1985 | Huckenbeck | 42/113 |
| 4,561,204 | A | 12/1985 | Binion | |
| 4,794,430 | A | 12/1988 | Whittaker et al. | |
| 4,806,007 | A | 2/1989 | Bindon | |
| 5,355,224 | A | 10/1994 | Wallace | |
| 5,414,557 | A | 5/1995 | Phillips | |
| 5,434,704 | A | 7/1995 | Connors et al. | |

(Continued)

FOREIGN PATENT DOCUMENTS

| | | |
|---|---|---|
| JP | 03-276116 | 12/1991 |

(Continued)

OTHER PUBLICATIONS

International Preliminary Report on Patentability (Chapter 1 of the Patent Cooperation Treaty), The International Bureau of WIPO, Simin Baharlou, Mailed Dec. 3, 2009.

*Primary Examiner*—Frank G Font
*Assistant Examiner*—Ryan Lepisto
(74) *Attorney, Agent, or Firm*—Harness, Dickey & Pierce, P.L.C.

(57) ABSTRACT

An optical sight is provided and may include a housing, at least one optic supported by the housing, and a fiber supported by the housing and selectively supplying light to the at least one optic. A sleeve may be supported by the housing and may include an opening that selectively exposes the fiber to vary an amount of light supplied to the at least one optic and a cover extending over the opening and movable with the sleeve relative to the fiber.

25 Claims, 20 Drawing Sheets

U.S. PATENT DOCUMENTS

| | | | | |
|---|---|---|---|---|
| 5,493,450 | A | 2/1996 | Ekstrand | |
| 5,653,034 | A * | 8/1997 | Bindon | 42/131 |
| 5,669,174 | A | 9/1997 | Teetzel | |
| 5,924,234 | A * | 7/1999 | Bindon et al. | 42/123 |
| 6,252,706 | B1 | 6/2001 | Kaladgew | |
| 6,327,806 | B1 | 12/2001 | Paige | |
| 6,601,308 | B2 * | 8/2003 | Khoshnood | 33/265 |
| 6,807,742 | B2 * | 10/2004 | Schick et al. | 33/297 |
| 6,813,025 | B2 | 11/2004 | Edwards | |
| RE39,686 | E * | 6/2007 | Khoshnood | 33/265 |
| 7,355,790 | B1 | 4/2008 | Wagner et al. | |
| 7,428,796 | B1 | 9/2008 | Stenton et al. | |
| 7,516,571 | B2 | 4/2009 | Scrogin et al. | |
| 2004/0025396 | A1 | 2/2004 | Schlierbach et al. | |
| 2005/0088729 | A1 | 4/2005 | Edwards | |
| 2005/0138824 | A1 * | 6/2005 | Afshari | 33/265 |
| 2005/0219690 | A1 | 10/2005 | Lin et al. | |
| 2005/0252062 | A1 | 11/2005 | Scrogin et al. | |
| 2005/0268521 | A1 | 12/2005 | Cox et al. | |
| 2006/0010760 | A1 | 1/2006 | Perkins et al. | |
| 2007/0097351 | A1 | 5/2007 | York et al. | |
| 2007/0175081 | A1 | 8/2007 | Lacorte | |
| 2007/0209268 | A1 | 9/2007 | Birurakis et al. | |
| 2007/0223088 | A1 | 9/2007 | Liao | |
| 2007/0277421 | A1 | 12/2007 | Perkins et al. | |
| 2008/0039962 | A1 | 2/2008 | McRae | |
| 2008/0295380 | A1 * | 12/2008 | Buckingham et al. | 42/131 |

FOREIGN PATENT DOCUMENTS

| | | |
|---|---|---|
| JP | 2000-314829 | 11/2000 |
| WO | WO97/00419 | 1/1997 |

* cited by examiner

OPTICAL SIGHT

CROSS-REFERENCE TO RELATED APPLICATIONS

This application claims the benefit of U.S. Provisional Application No. 60/939,483, filed on May 22, 2007. The disclosure of the above application is incorporated herein by reference.

FIELD

The present disclosure relates to optical sights and more particularly to an optical gun sight for use with a firearm.

BACKGROUND

The statements in this section merely provide background information related to the present disclosure and may not constitute prior art.

Optical sights are conventionally used with firearms such as guns and/or rifles to allow a user to more clearly see a target. Conventional optical sights include a series of lenses that magnify an image and provide a reticle that allows a user to align a magnified target relative to a barrel of the firearm. Proper alignment of the optical sight with the barrel of the firearm allows the user to align the barrel of the firearm and, thus, a projectile fired therefrom, with a target by properly aligning a magnified image of the target with the reticle pattern of the optical sight.

While conventional optical sights adequately magnify an image and properly align the magnified image with a barrel of a firearm, conventional optical sights do not provide an illumination system that allows for adjustment of illumination of a reticle pattern of the optical sight. Furthermore, while conventional optical sights may include an illumination system for illuminating a reticle pattern, such systems do not typically include multiple power sources and are not responsive to environmental conditions.

SUMMARY

An optical sight is provided and may include a housing, at least one optic supported by the housing, and a fiber supported by the housing and selectively supplying light to the at least one optic. A sleeve may be supported by the housing and may include an opening that selectively exposes the fiber to vary an amount of light supplied to the at least one optic and a cover extending over the opening and movable with the sleeve relative to the fiber.

An optical sight is provided and may include a housing, at least one optic supported by the housing, and a fiber supported by the housing, whereby the fiber selectively supplies light to the at least one optic and is wrapped around an entire perimeter of the housing. A sleeve may be supported by the housing and may include an opening that selectively exposes the fiber to vary an amount of light supplied to the at least one optic and a cover extending over the opening and spaced apart from the fiber to permit movement of the cover relative to the fiber.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
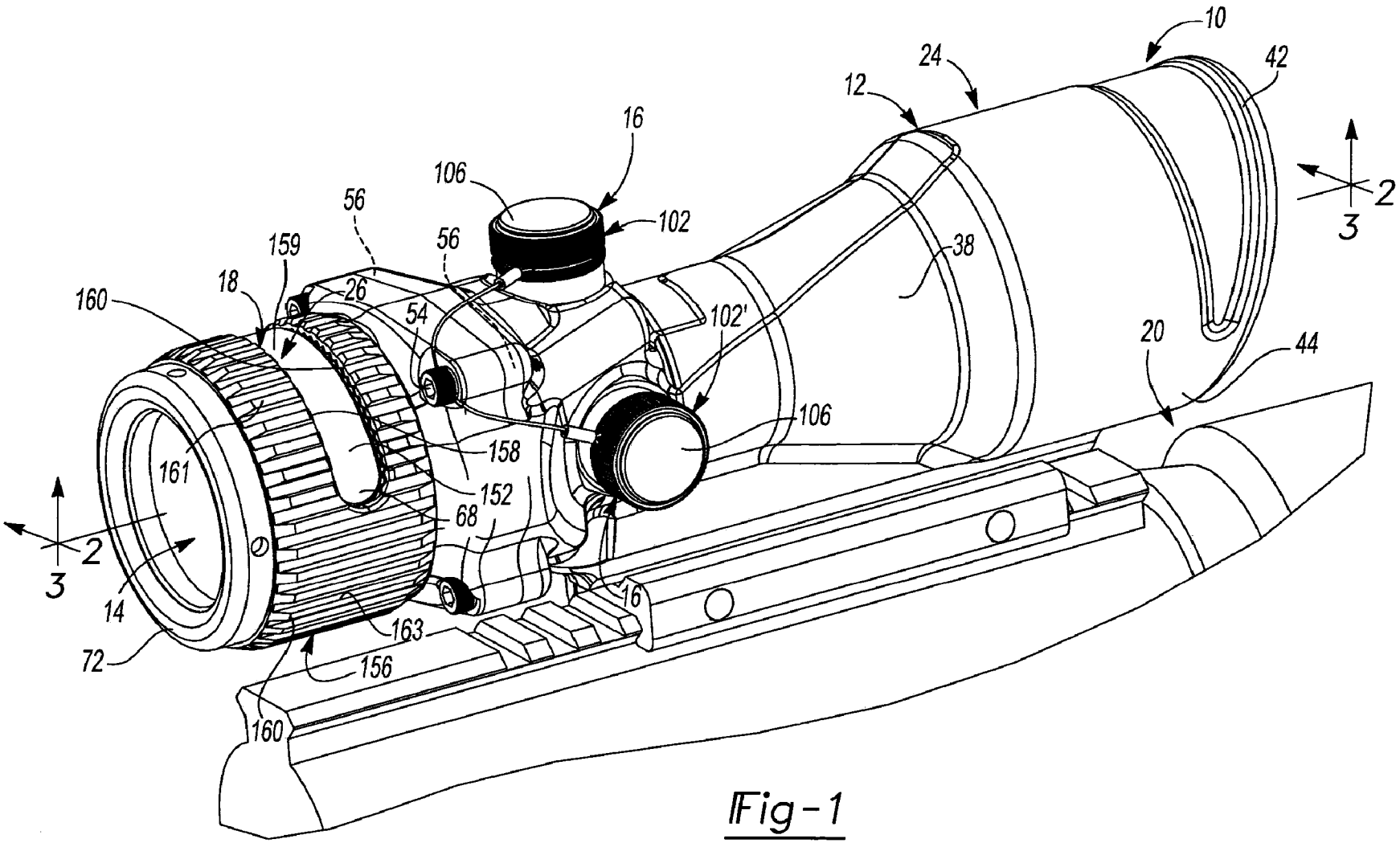
FIG. 1 is a partial perspective view of a firearm incorporating an optical sight in accordance with the principles of the present teachings.

The following description is merely exemplary in nature and is not intended to limit the present disclosure, application, or uses. It should be understood that throughout the drawings, corresponding reference numerals indicate like or corresponding parts and features.

With reference to the figures, an optical gun sight 10 is provided and includes a housing 12, an optics train 14, an adjustment system 16, and an illumination system 18. The housing 12 may be selectively attached to a firearm 20 and supports the optics train 14, adjustment system 16, and illumination system 18. The optics train 14 cooperates with the housing 12 to provide a magnified image of a target while the adjustment system 16 positions the optics train 14 relative to the housing 12 to properly align the optics train 14 relative to the firearm 20. In one configuration, the optics train 14 magnifies a target to a size substantially equal to six times the viewed size of the target (i.e., 6× magnification). The illumination system 18 cooperates with the optics train 14 to illuminate a reticle pattern 22 (FIGS. 40 and 41) to assist in aligning the target relative to the optical gun sight 10 and firearm 20.

The housing 12 includes a main body 24 attached to an eyepiece 26. The main body 24 includes a series of threaded bores 28 for use in attaching the housing 12 to the firearm 20 and an inner cavity 30 having a longitudinal axis 32. A first end 34 of the main body 24 includes a substantially circular shape and is in communication with the inner cavity 30 of the housing 12. A second end 36 is disposed generally on an opposite side of the main body 24 from the first end 34 and similarly includes a generally circular cross section. A tapered bore portion 38 is disposed between the first end 34 and second end 36 and includes a stepped surface 40 that defines a profile of the tapered bore portion 38.

The first end 34 of the main body 24 includes an entrance pupil having a larger diameter than an exit pupil of the second end 36. The entrance pupil of the first end 34 defines how much light enters the optical gun sight 10 and cooperates with the exit pupil to provide the optical gun sight 10 with a desired magnification. In one configuration, the entrance pupil includes a diameter that is substantially six times larger than a diameter of the exit pupil. Such a configuration provides the optical gun sight 10 with a "6× magnification." While the exit pupil is described as being six times smaller than the entrance pupil, the exit pupil may be increased to facilitate alignment of a user's eye with the optical gun sight 10. The first end 34 may include a truncated portion 42 that extends toward a target a greater distance than a bottom portion 44 to prevent ambient light from causing a glare on the optics train 14.

The main body 24 supports the adjustment system 16 and may include at least one bore 46 that operably receives a portion of the adjustment system 16 therein. The main body 24 may also include an inner arcuate surface 48 that cooperates with the adjustment system 16 to adjust a position of the reticle pattern 22 relative to a target.

The main body 24 may include a locking feature 50 that cooperates with the eyepiece 26 to position the main body 24 relative to the eyepiece 26 and attaches the main body 24 to the eyepiece 26. The locking feature 50 may include a tab 52 extending from the main body 24 for interaction with the eyepiece 26. An annular seal 53 may be disposed between the main body 24 and the eyepiece 26 for providing a seal between mating flange surfaces. For example, the annular seal 53 may be disposed in the locking feature 50 for providing such a seal. While the main body 24 is described as including locking feature 50 having tab 52 and annular seal 53, the main body 24 could additionally and/or alternatively include any locking feature that attaches the main body 24 to the eyepiece 26. For example, the locking feature 50 could include a series of fasteners 54 (FIG. 1) that are received through the eyepiece 26 and inserted into the main body 24 to position the eyepiece 26 relative to the main body 24 and to attach the eyepiece 26 to the main body 24. If fasteners 54 are used to attach the eyepiece 26 to the main body 24, the main body 24 may include a series of threaded bores 56 that matingly receive the fasteners 54.

The eyepiece 26 is matingly received by the main body 24 and may be attached thereto via the locking feature 50, as described above. As such, the eyepiece 26 may similarly include threaded bores 58 (not shown) that matingly receive the fasteners 54.

The eyepiece 26 includes a longitudinal axis 60 that is co-axially aligned with the longitudinal axis 32 of the main body 24 when the eyepiece 26 is assembled to the main body 24. The eyepiece 26 includes a first end 62 attached to the main body 24 via the locking feature 50 and a second end 64 disposed on an opposite end of the eyepiece 26 from the first end 62. The first end 62 may include an inner arcuate surface 66 that is aligned with the inner arcuate surface 48 of the main body 24 when the eyepiece 26 is attached to the main body 24. The inner arcuate surface 66 cooperates with the inner arcuate surface 48 of the main body 24 to create a spherical seat, which permits movement of a portion of the optics train 14 relative to the housing 12 during adjustment of the optics train 14. As will be described further below, movement of a portion of the optics train 14 relative to the housing 12 provides for adjustment for the reticle pattern 22 relative to the housing 12 and, thus, alignment of the optical gun sight 10 relative to the firearm 20. A retainer ring 72 may be positioned at a distal end of the eyepiece 26, adjacent to the illumination system 18, and may be used to retain an adjustment mechanism such as, for example, a rotary dial of the illumination system 18. The first end 62 may also include a recess 68 that receives at least a portion of the illumination system 18.

Figure 2:
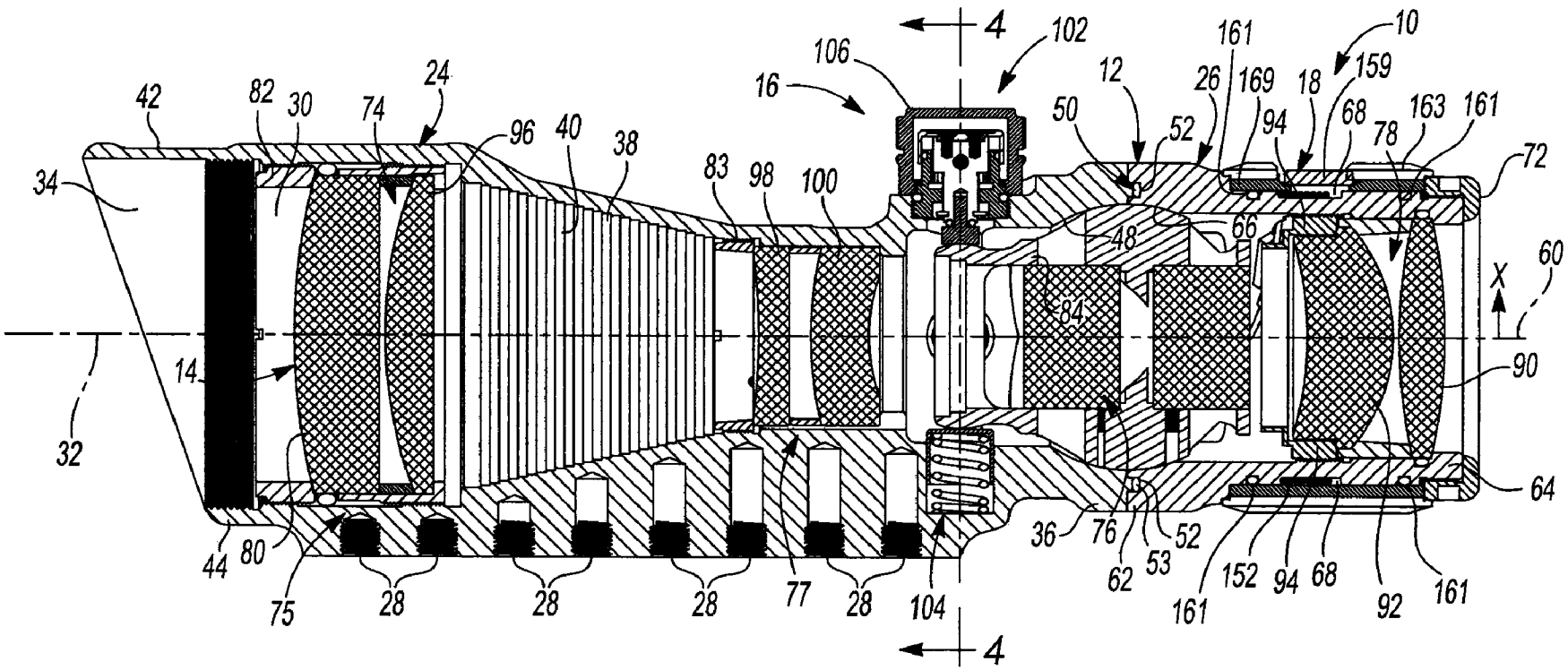
FIG. 2 is a cross-sectional view of the optical sight of FIG. 1 taken along line 2-2 of FIG. 1.
Figure 3:
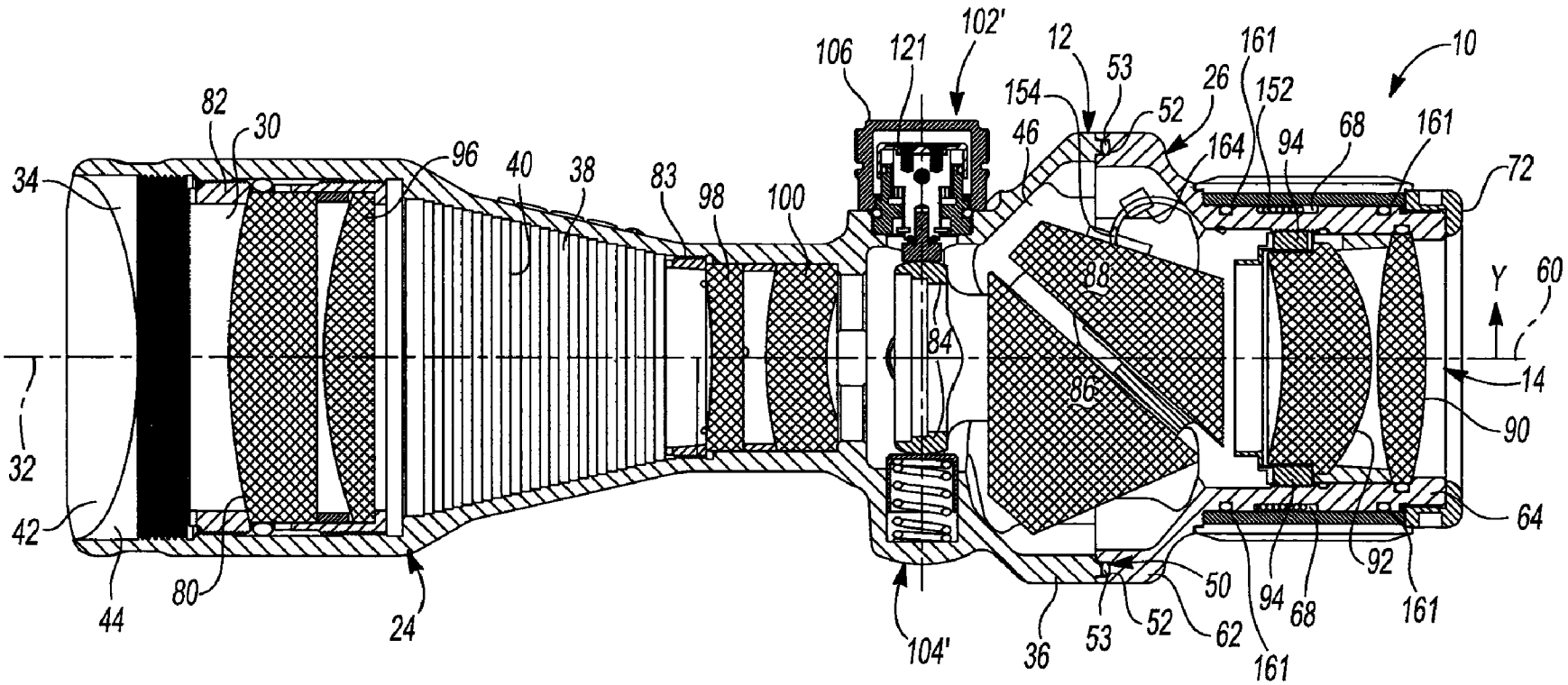
FIG. 3 is a cross-sectional view of the optical sight of FIG. 1 taken along line 3-3.

With particular reference to FIGS. 2 and 3, the optics train 14 is shown to include an objective lens system 74, an image erector system 76, and an ocular lens system 78. The objective lens system 74 is a telephoto objective and includes a front positive power group 75 and a rear negative power group 77. The front positive power group 75 is disposed generally proximate to the first end 34 of the main body 24 and includes a convex-piano doublet lens 80 having a substantially doublet-convex lens and a substantially concave-convex lens secured together by a suitable adhesive and a convex-piano singlet lens 96. The lenses 80, 96 may be secured within the first end 34 of the main body 24 via a threaded retainer ring 82 and/or adhesive to position and attach the lenses 80, 96 relative to the main body 24 of the housing 12.

The rear negative power group 77 is disposed generally between the front positive power group 75 and the second end 36 of the main body 24 and includes a concave-piano singlet lens 98 and a convex-concave doublet lens 100. As with the front positive power group 75, the singlet lens 98 and doublet lens 100 of the rear negative power group 77 may be retained and positioned within the main body 24 of the housing 12 via a threaded retainer 83 and/or an adhesive.

The image erector system 76 is disposed within the housing 12 generally between the objective lens system 74 and the ocular lens system 78. The image erector system 76 includes a housing 84, a roof prism 86, and a mirror prism 88, which cooperate to form a Pechan prism assembly. The image erector system 76 cooperates with the objective lens system 74 and ocular lens system 78 to properly orient an image of a sighted target relative to the housing 12, and thus, the firearm 20. For example, when an image is received at the first end 34 of the main body 24, the image travels along the longitudinal axis 32 of the main body 24 and travels along a light path of the Pechan prism assembly prior to being viewed at the eyepiece 26. The image erector system 76 also cooperates with the illumination system 18 to provide the overall shape and size of the reticle pattern 22 displayed at an eyepiece lens 90. The Pechan prism assembly is preferably of the type disclosed in Assignee's commonly owned U.S. Pat. No. 4,806,007, the disclosure of which is incorporated herein by reference.

The image from the image erector system 76 is received by the ocular lens system 78 disposed proximate to the eyepiece 26. The ocular lens system 78 is disposed generally on an opposite end of the optical gun sight 10 from the objective lens system 74 and includes the eyepiece lens 90, which may be of a bi-convex singlet or substantially doublet-convex type lens, and a doublet ocular lens 92. Hereinafter, the eyepiece lens 90 will be described as doublet-convex eyepiece lens 90. The doublet ocular lens 92 may include a substantially doublet-convex lens and a substantially doublet-concave lens secured together by a suitable adhesive. The doublet-convex eyepiece lens 90 and doublet ocular lens 92 may be held in a desired position relative to the eyepiece 26 of the housing 12 via a threaded retainer ring 94. While threaded retainer ring 94 is disclosed, the doublet-convex eyepiece lens 90 and doublet ocular lens 92 could alternatively and/or additionally be attached to the eyepiece 26 of the housing 12 using an adhesive.

The optical gun sight 10 provides a magnification of a target of approximately six times (i.e., 6× magnification) the size of the viewed target (i.e., the target as viewed without using the optical gun sight 10). Increasing the ability of the optical gun sight 10 to magnify an image of a target improves the ability of the optical gun sight 10 in enlarging distant targets and allows the optical gun sight 10 to enlarge targets at greater distances. Generally speaking, such improvements in magnification can be achieved by introducing an objective lens having a longer focal length. However, increasing the length of the objective lens focal length increases the overall length of the housing 12 and therefore also increases the overall length and size of the optical gun sight 10.

As described above, a 6× magnification is achieved in the present disclosure by increasing the objective lens focal length through use of multiple lenses. Cooperation between the convex-piano singlet lens 96, concave-piano singlet lens 98, and doublet lens 100 with the objective lens system 74, image erector system 76, and ocular lens system 78 provides the optical gun sight 10 with the ability to magnify a target six times greater than the viewed size of the target. Specifically, adding lenses 96, 98, and 100 to the front positive power group 75 and a rear negative power group 77, respectively, allows the optical sight 10 to have a 6× magnification without requiring a lengthy and cumbersome housing.

Figure 4A:
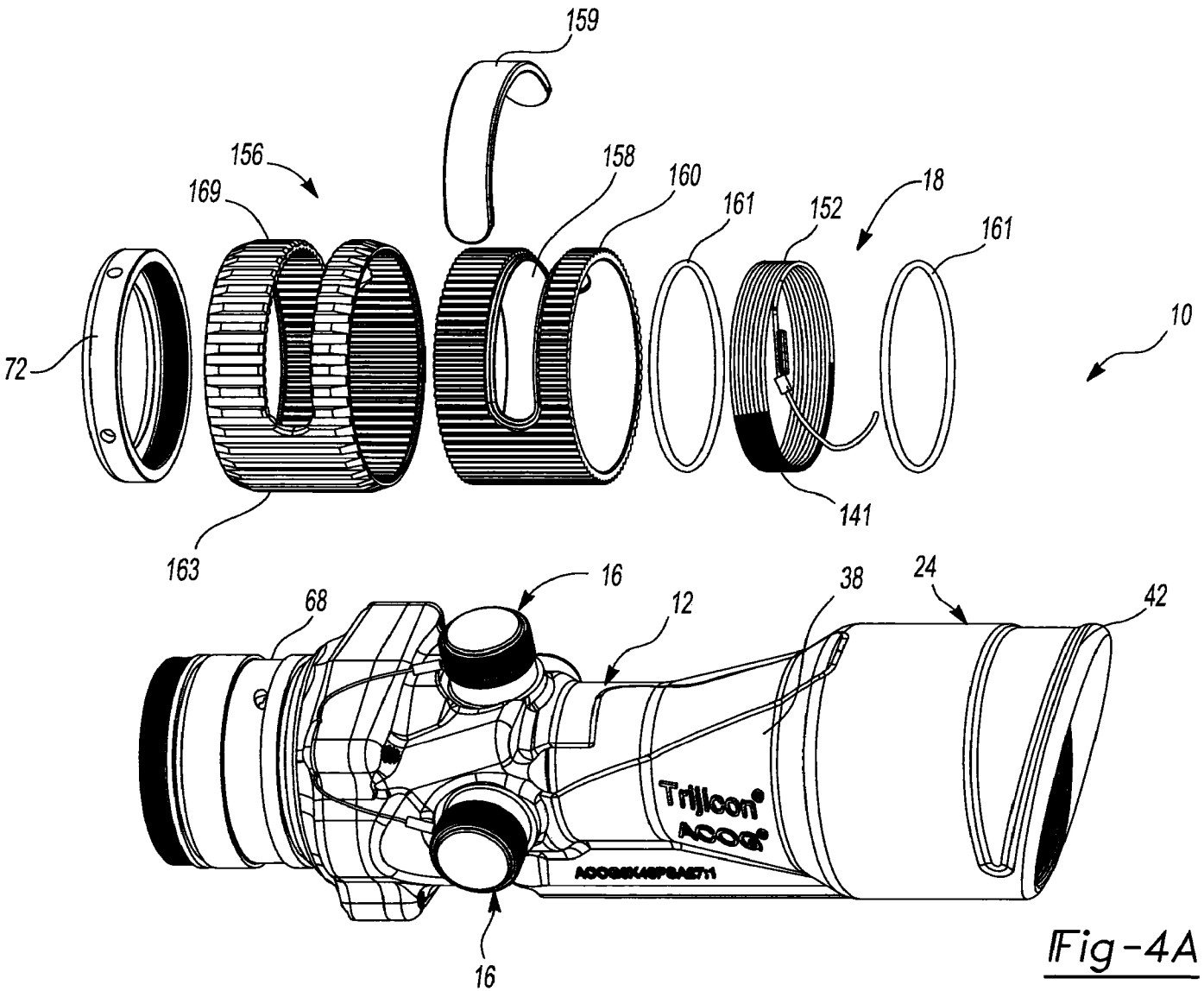
FIG. 4A is an exploded view of an illumination system for use with the optical sight of FIG. 1.
Figure 4B:
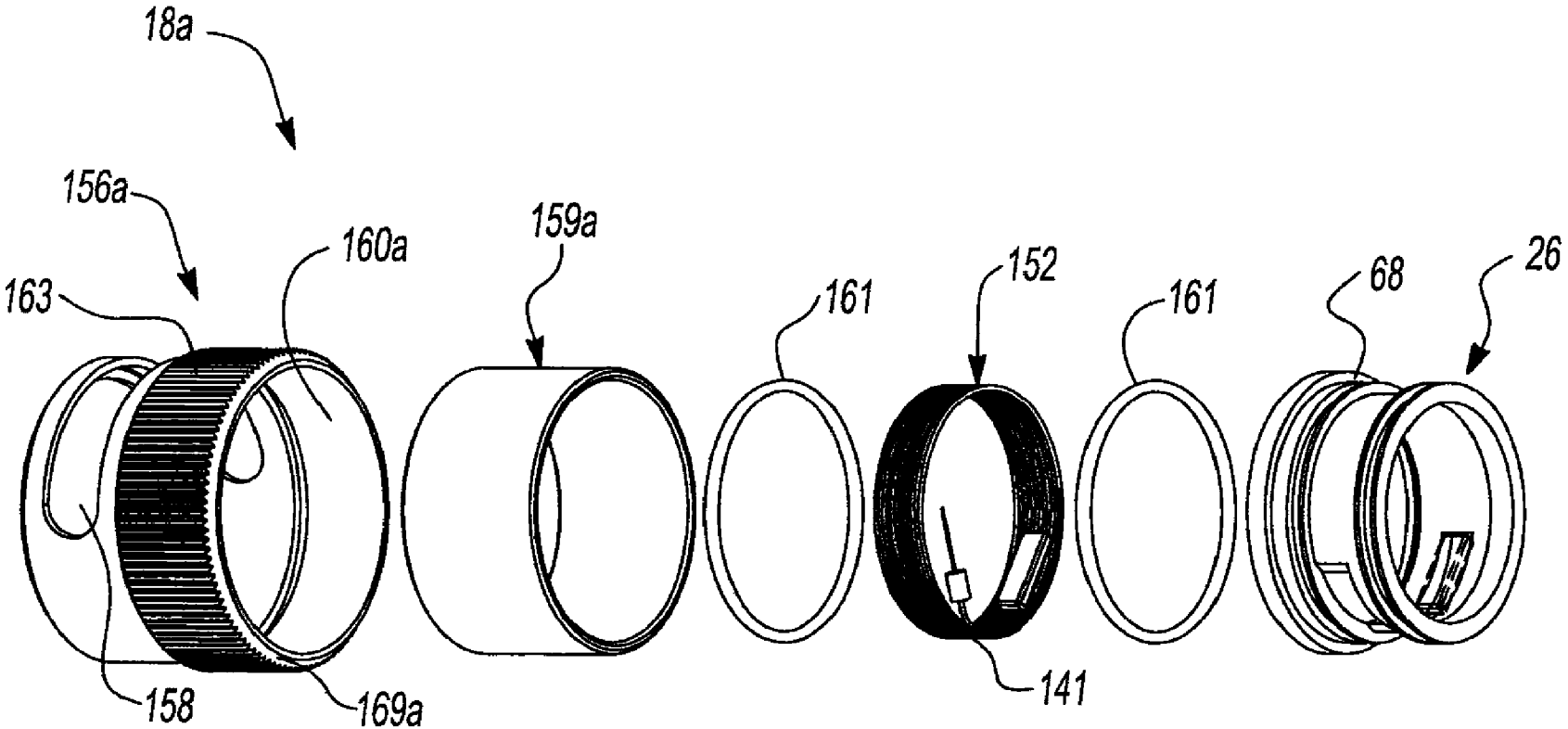
FIG. 4B is an exploded view of an illumination system for use with an optical sight.
Figure 5A:
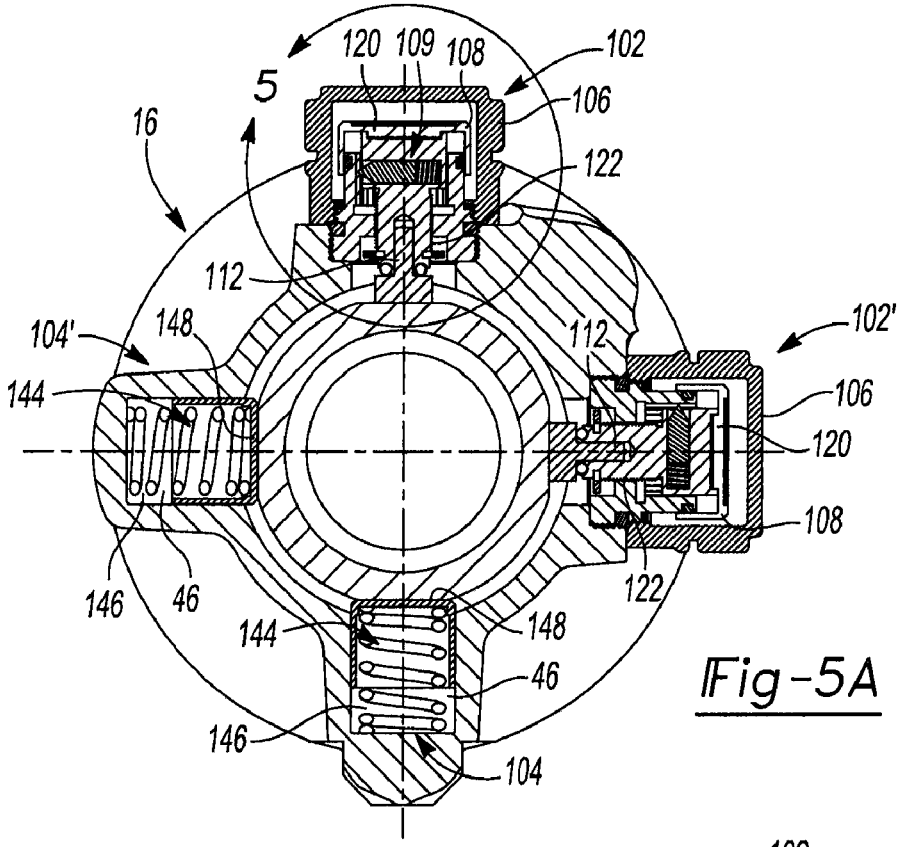
FIG. 5A is a cross-sectional view of an adjustment assembly of the optical sight of FIG. 1.
Figure 5B:
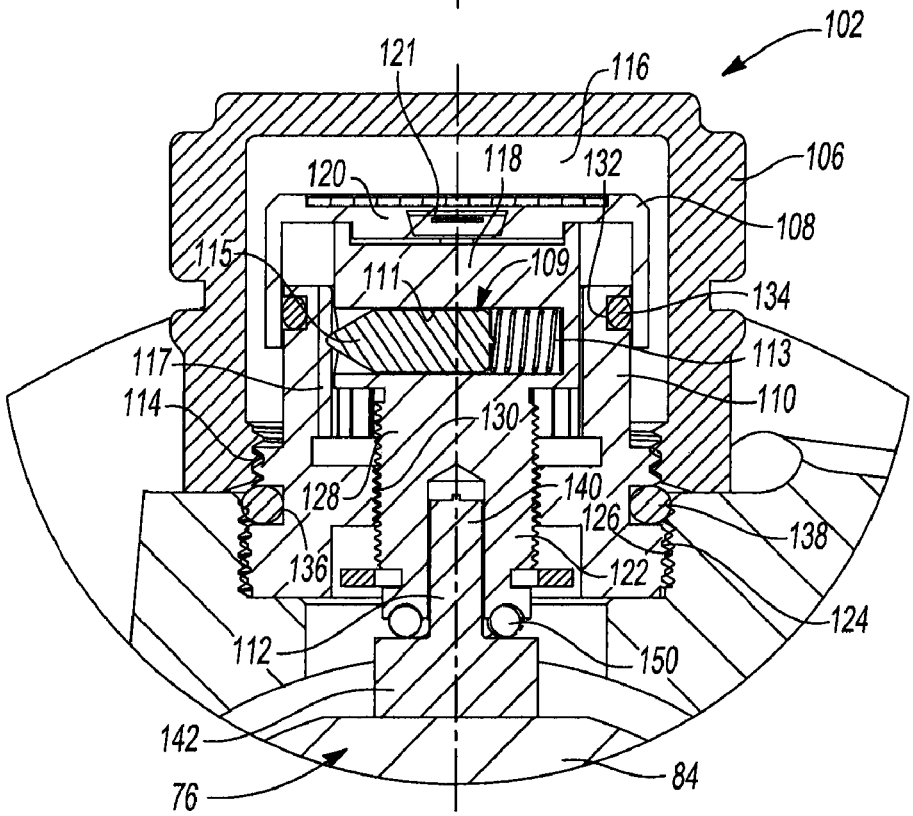
FIG. 5B is a partial cross-sectional view of an adjuster of the adjustment assembly of FIG. 5A.

With particular reference to FIGS. 4 and 5, the adjustment system 16 is shown to include adjustment assemblies 102, 102' and biasing assemblies 104, 104'. The adjustment assemblies 102, 102' cooperate with the biasing assemblies 104, 104' to selectively move the housing 84 of the image erector system 76 relative to the housing 12. Movement of the housing 84 of the image erector system 76 relative to the housing 12 similarly moves the roof prism 86 and mirror prism 88 relative to the housing 12 and therefore may adjust a position of the reticle pattern 22 relative to the housing 12. Such adjustments of the reticle pattern 22 relative to the housing 12 may be used to align the reticle 22 relative to the firearm 20 to account for windage and elevation.

As shown in FIGS. 2 and 5, the optical gun sight 10 of the present teachings includes first adjuster assembly 102 and first biasing assembly 104 that cooperate to rotate the housing 84 of the image erector system 76 relative to the housing 12 to adjust an elevation of the reticle pattern 22. Rotation of the housing 84 causes the reticle pattern 22 to move in a direction substantially perpendicular to axes 32, 60, as schematically represented by arrow "X" in FIG. 2.

As shown in FIGS. 3 and 5, the optical gun sight 10 of the present teachings includes second adjuster assembly 102' and second biasing assembly 104' that also cooperate with each other to move the housing 84 of the image erector system 76 relative to the housing 12. Movement of the housing 84 of the image erector system 76 relative to the housing 12 similarly moves the reticle pattern 22 relative to the housing 12. Such movement of the reticle pattern 22 relative to the housing 12 may be performed to adjust for windage to properly align the reticle pattern 22 relative to the housing 12 and, thus, the optical gun sight 10 with the firearm 20. Such movement of the reticle pattern 22 is substantially perpendicular to axes 32, 60 and to arrow X, as schematically represented by arrow "Y" in FIG. 3.

Because the first adjuster assembly 102 is substantially identical to the second adjuster assembly 102' and the first biasing assembly 104 is substantially identical to the second biasing assembly 104', a detailed description of the second adjuster assembly 102' and second biasing assembly 104' is foregone.

With reference to FIGS. 4 and 5, the first adjuster assembly 102 is shown to include a cap 106, an adjustment knob 108, a detent assembly 109, a hollow adaptor 110, and an engaging pin 112. The cap 106 is selectively attachable to the housing 12 and may include a series of threads 114 for mating engagement with the hollow adaptor 110. The cap 106 includes an inner volume 116 that generally receives the adjustment knob 108 and a portion of the hollow adaptor 110. While the cap 106 is shown and described as including the series of threads 114 that selectively attach the cap 106 to the housing 12, the cap 106 could include any feature that allows for selective attachment of the cap 106 to the housing 12 such as, for example, a snap fit and/or mechanical fastener.

The adjustment knob 108 is disposed generally within the inner volume 116 of the cap 106 and includes a plug 118 rotatably attached to the hollow adaptor 110 and a top cap 120 attached to the plug 118 via a series of fasteners 121 and/or adhesive. The plug 118 includes a threaded extension 122 that is matingly received with the hollow adaptor 110 such that rotation of the plug 118 and top cap 120 relative to the hollow adaptor 110 causes the plug 118 and top cap 120 to move towards or away from the housing 12, depending on the direction of rotation of the plug 118 relative to the hollow adaptor 110.

The detent assembly 109 may be located in a radial cross bore 111 formed through the plug 118 and may include a spring 113 that imparts a biasing force on a detent pin 115. The bias imparted on the detent pin 115 by the spring 113 urges the detent pin 115 outwardly from the cross bore 111 and into engagement with a side wall of the hollow adaptor 110. A plurality of axially extending grooves 117 may be circumferentially located at spaced-apart intervals around an inner surface of the hollow adaptor 110 such that upon threadably advancing or retracting the plug 118, discernible physical and/or audible 'clicks' can be sensed by the operator, as the detent pin 115 moves into an adjacent groove 117 to facilitate calibration of the optical sight 10.

The hollow adaptor 110 is attached to the housing 12 and may include a series of external threads 124 that are matingly received within a threaded bore 126 of the housing 12. While the hollow adaptor 110 is described and shown as being attached to the housing 12 via a threaded connection, the hollow adaptor 110 could be attached to the housing 12 via any suitable means such as, for example, an epoxy and/or press fit.

The hollow adaptor 110 includes a central bore 128 having a series of threads 130 that matingly receive the threaded extension 122 of the plug 118. As described above, when a force is applied to the adjustment knob 108 such that the plug 118 and threaded extension 122 rotate relative to the hollow adaptor 110, the plug 118 and threaded extension 122 move towards or away from the housing 12 due to engagement between the threaded extension 122 of the plug 118 and the threads 130 of the hollow adaptor 110. The hollow adaptor 110 may also include at least one recess 132 formed on an outer surface thereof for receiving a seal 134 to seal a connection between the hollow adaptor 110 and the housing 12. A similar recess 136 may be formed in the hollow adaptor 110 proximate to the top cap 120 of the adjustment knob 108 and may similarly receive a seal 138 to seal a connection between the hollow adaptor 110 and the top cap 120 of the adjustment knob 108. The recesses 132, 136 may be formed integrally with the hollow adaptor 110 and/or may be machined in an outer surface of the hollow adaptor 110. The seals 134, 138 may be any suitable seal such as, for example, an O-ring.

Engaging pin 112 is received generally within the threaded extension 122 of the plug 118 and includes an attachment portion 140 rotatably received within the threaded extension 122 of the plug 118 and an engagement portion 142 extending from a distal end of the attachment portion 140. The threaded extension 122 is fixed for movement with the plug 118.

The engagement portion 142 extends from the attachment portion 140 and is in contact with the housing 84 of the image erector system 76. The first biasing assembly 104 biases the housing 84 of the image erector system 76 into engagement with the engagement portion 142 of the engaging pin 112. The first biasing assembly 104 includes a biasing member 144 disposed within a bore 146 of the housing 12. The biasing member 144 may be in contact with the housing 84 of the image erector system 76 or, alternatively, a cap 148 may be disposed generally between the biasing member 144 and the housing 84 of the image erector system 76. In either configuration, the biasing member 144 applies a force to the housing 84 of the image erector system 76, urging the housing 84 into engagement with the engagement portion 142 of the engaging pin 112. The biasing member 144 may be any suitable spring such as, for example, a coil spring or a linear spring.

Because the housing 84 of the image erector system 76 is biased into engagement with the engagement portion 142 of the engaging pin 112, movement of the engaging pin 112 relative to the hollow adaptor 110 causes movement of the housing 84 of the image erector system 76 relative to the housing 12. Positioning ball bearings 150 generally between the engagement portion 142 and a bottom portion of the hollow adaptor 110 may dampen such movement of the engaging pin 112 relative to the hollow adaptor 110. The ball bearings 150 may provide a seal between the engagement portion 142 and the hollow adaptor 110 and may also dampen movement of the engaging pin 112 when the engaging pin 112 is moved toward and away from the housing 12 to ensure quiet operation of the adjustment system 16.

With continued reference to FIGS. 4 and 5, operation of the adjustment system 16 will be described in detail. To adjust the elevation of the reticle pattern 22 relative to the housing 12, the cap 106 is removed from engagement with the housing 12. In one configuration, the cap 106 is threadably attached to the housing 12. Therefore, to remove the cap 106 from engagement with the housing 12, a force is applied to the cap 106 to rotate the cap 106 relative to the housing 12. Once the cap 106 has been rotated sufficiently relative to the housing 12, the cap 106 may be removed from engagement with the housing 12.

Removal of the cap 106 from engagement with the housing 12 exposes the top cap 120 of the adjustment knob 108. Exposing the adjustment top cap 120 allows a force to be applied to the plug 118 of the adjustment knob 108 via the top cap 120. A rotational force may be applied generally to the top cap 120 of the adjustment plug 118 to rotate the plug 118 and threaded extension 122 relative to the hollow adaptor 110. Rotation of the plug 118 and threaded extension 122 relative to the hollow adaptor 110 causes the threaded extension 122 to move relative to the central bore 128 of the hollow adaptor 110.

As described above, the central bore 128 may include threads 130 that engage the threaded extension 122. Therefore, as the plug 118 and threaded extension 122 are rotated relative to the housing, the plug 118, top cap 120 and threaded extension 122 are caused to move towards or away from the hollow adaptor 110 due to engagement between the threads 130 of the central bore 128 and the threaded extension 122, depending on the direction of rotation of the threaded extension 122. The engaging pin 112 is attached to the threaded extension 122 of the adjustment knob 108 and therefore moves with the plug 118, top cap 120, and threaded extension 122 when the plug 118, top cap 120, and threaded extension 122 move relative to the hollow adaptor 110.

When the force applied to the top cap 120 causes the threaded extension 122 to move towards the hollow adaptor 110, the engaging pin 112 applies a force in a "Z" direction (FIG. 5B) to the housing 84 of the image erector system 76. Application of a force in the Z direction to the housing 84 of the image erector system 76 causes the housing 84 to move against the bias imparted on the housing 84 by the first biasing assembly 104. Such movement of the housing 84 causes concurrent movement of the reticle pattern 22 in the Z direction relative to the housing 12 and therefore adjusts the elevation of the reticle pattern 22 relative to the housing 12.

When a force is applied to the top cap 120 in an opposite direction, the threaded extension 122 and engaging pin 112 move away from the hollow adaptor 110 in the Z direction. The housing 84 of the image erector system 76 similarly moves in a direction opposite to the Z direction due to the force imparted on the housing 84 by the biasing member 144 of the first biasing assembly 104. As noted above, regardless of movement of the threaded extension 122 and engaging pin 112 in a direction generally opposite to the Z direction, the housing 84 of the image erector system 76 is maintained in contact with the engagement portion 142 of the threaded extension 122 due to the force imparted on the housing 84 of the image erector system 76 by the biasing member 144 of the first biasing assembly 104.

Once the elevation of the reticle pattern 22 is adjusted relative to the housing 12, the cap 106 may be positioned over the adjustment knob 108 and hollow adaptor 110 and may be reattached to the housing 12. Attachment of the cap 106 to the housing 12 prevents further manipulation of the adjustment knob 108 and therefore aids in preventing further adjustment of the elevation of the reticle pattern 22 until the cap 106 is once again removed from the housing 12. In other words, the cap 106 prevents inadvertent forces from being applied to the top cap 120 causing the plug 118 and threaded extension 122 from rotating relative to the hollow adaptor 110 when an elevational adjustment is not desired. A similar approach may be performed on the second adjustment assembly 102' and second biasing assembly 104' to adjust the windage by moving the reticle pattern 22 relative to the housing 12 in a direction substantially perpendicular to the Z direction.

With particular reference to FIGS. 1-4B, the illumination system 18 is shown to include a fluorescent fiber 152 attached to the eyepiece 26 of the housing 12. The fluorescent fiber 152 is shown as being wound around an exterior surface of the eyepiece 26 and is generally received within the recess 68 of the eyepiece 26. The fluorescent fiber 152 may capture ambient light, illuminate the ambient light at a predetermined color (red or yellow, for example), and direct the ambient light along a length of the fluorescent fiber 152. The fluorescent fiber 152 is preferably of the type disclosed in Assignee's commonly owned U.S. Pat. Nos. 4,806,007 and 6,807,742, the disclosures of which are incorporated herein by reference.

The fluorescent fiber 152 may axially surround the eyepiece 26 of the housing 12 such that the fiber 152 surrounds an entire perimeter of the eyepiece 26 (i.e., is wrapped 360 degrees around an outer surface of the eyepiece 26). The fluorescent fiber 152 may include an end disposed within the eyepiece 26 that is directed generally towards the image erector system 76 to illuminate the reticle pattern 22. For example, the fluorescent fiber 152 may include an end 154 (FIG. 3) that extends from the recess 68 of the eyepiece 26 that is attached to the mirror prism 88 to illuminate the reticle portion 22. In operation, the fluorescent fiber 152 receives ambient light and directs the ambient light along a length of the fluorescent fiber 152 and generally towards end 154. Upon reaching end 154 of the fluorescent fiber 152, the light is supplied to the mirror prism 88 to illuminate the reticle pattern 22. The reticle pattern 22 may be etched in a face of the mirror prism 88 such that light from the fluorescent fiber 152 illuminates only the etched portion of the mirror prism 88, as described in Assignee's commonly owned U.S. Pat. No. 4,806,007. In other words, light from the fluorescent fiber 152 is only transmitted through the mirror prism 88 at a portion of the mirror prism 88 that is etched and therefore only the transmitted portion is viewed at the eyepiece lens 90. The reticle pattern 22 is therefore defined by the overall shape and size of the etched portion of the mirror prism 88. Because the fluorescent fiber 152 collects and directs ambient light along a length of the fluorescent fiber 152 towards end 154, the fluorescent fiber 152 may be considered a conduit that traps ambient light and directs the ambient light along a length of the fluorescent fiber 152.

Wrapping the fluorescent fiber 152 completely around the exterior surface of the eyepiece 26 increases the overall surface area of exposed fiber 152, which maximizes the amount of light that may be received by the fiber 152. Furthermore, wrapping the fluorescent fiber 152 completely around the eyepiece 26 reduces the overall length of the optical scope 10, as width of the wound fiber 152 is reduced while still maintaining a sufficient area of exposed fiber 152 to collect light.

While wrapping the fluorescent fiber 152 completely around the eyepiece 26 increases the surface area of exposed fiber 152, a portion of the wound fiber 152 may include a coating 141 (FIG. 4A) to restrict light from being collected by the fiber 152. For example, a coating, such as a black mask, may be applied to a portion of the wound fiber 152 on a bottom portion of the optical sight 10. The coating prevents light from being collected by the fiber 152 where the mask is applied to limit light collection to a region generally between ends of the coating.

Illumination of the reticle pattern 22 allows use of the optical gun sight 10 in various environmental conditions. Illumination of the reticle pattern 22 may be adjusted depending on such environmental conditions. For example, in dark conditions, the reticle pattern 22 may be illuminated to allow use of the optical gun sight 10 at night time and/or under dark conditions such as, for example, in a building. In other conditions, the reticle pattern 22 may be illuminated to allow the reticle pattern 22 to stand out in a bright place, such as when using the optical gun sight 10 in sunlight and/or amongst other illuminated devices (i.e., traffic or brake lights in a military combat zone, for example).

Illumination of the reticle pattern 22 is dictated generally by the conditions in which the optical gun sight 10 is used. For example, when using the optical gun sight 10 at night, the reticle pattern 22 may only be illuminated sufficiently such that a user may see the reticle pattern 22 but not to such an extent that the reticle pattern 22 is visible at the first end 34 of the housing 12. In contrast, when using the optical gun sight 10 in sunny conditions and amongst other lights, such as, for example traffic lights in a military combat zone, the reticle pattern 22 may be illuminated to a greater extent to allow the reticle pattern 22 to stand out from the bright lights and allow the user to clearly see the reticle pattern 22.

Adjustment of the amount of light supplied to the reticle pattern 22 may be incorporated in the illumination system 18 through a rotary dial or sleeve 156 movably supported by the eyepiece 26 of the housing 12. While the dial/sleeve 156 will hereinafter be described and shown in the drawings as being rotatable relative to the housing 12, the dial/sleeve 156 could alternatively be slidable or otherwise movable relative to the housing 12 to selectively expose the fluorescent fiber 152.

The rotary dial 156 may include a body 160 having an opening 158 formed therethrough that selectively allows ambient light through the rotary dial 156. The body 160 may be formed from a rigid material such as, for example, metal, and may be rotatably supported relative to the housing 12 by the eyepiece 26. The opening 158 may include a cover 159 that is attached to the rotary dial 156 and rotates with the rotary dial 156. The cover 159 may be formed from a transparent or translucent material such as, for example, clear plastic. While the cover 159 is described as being formed from a clear plastic material, the cover 159 may be formed from any material that permits light to pass therethrough and be collected by the fluorescent fiber 152.

Allowing the cover 159 to rotate with the rotary dial 156 seals the recess 68 and prevents intrusion of dust and other debris into the recess 68. Preventing dust and other debris from entering the recess 68 likewise prevents such contaminants from encountering the fluorescent fiber 152, which prevents damage to the fiber 152 and maintains an outer surface of the fiber 152 clean. Furthermore, by attaching the cover 159 to the rotary dial 156, the cover 159 rotates with the dial 156 and is spaced apart from the fiber 152. As such, any dust and/or other debris disposed between the cover 159 and the fiber 152 does not damage an outer surface of the fiber 152 when the rotary dial 156 is moved relative to the fiber 152. Furthermore, because the cover 159 rotates with the rotary dial 156, dust and/or other debris is not allowed to collect between an outer surface of the cover 159 and the rotary dial 156, thereby preventing damage to the outer surface of the cover 159 caused by movement of the rotary dial 156 relative to the cover 159.

A pair of O-ring seals 161 may be provided generally between the body 160 and an outer surface of the eyepiece 26 to prevent the intrusion of dust and other debris between the cover 159 and the recess 68 and to space the body 160 away from the fiber 152. The O-ring seals 161 may provide the recess 68 with an air-tight seal that prevents intrusion of fluid such as, for example, air, nitrogen, and/or water or other debris such as dust and/or dirt into the recess 68. For example, in one configuration, the O-ring seals 161 provide a hermetic seal between the body 160 and the eyepiece 26. The O-ring seals 161 may be formed from an elastomeric material such as, for example, rubber.

An elastomeric material 169, such as, for example, rubber, may be disposed generally around an outer surface of the body 160. The elastomeric material 169 may include a series of projections 163 that facilitate gripping and turning of the body 160 and, thus, the rotary dial 156. The elastomeric material 169 may be positioned such that the elastomeric material 169 completely surrounds the cover 159 and further seals an interface between the body 160 and the cover 159 to prevent intrusion of fluid and/or other debris from entering the recess 68 and interfering with operation of the fluorescent fiber 152.

With particular reference to FIG. 4B, another illumination system 18*a* is provided for use with the optical sight 10. In view of the substantial similarity in structure and function of the components associated with the illumination system 18 with respect to the illumination system 18*a*, like reference numerals are used hereinafter and in the drawings to identify like components while like reference numerals containing letter extensions are used to identify those components that have been modified.

The illumination system 18*a* may include a body 160*a* rotatably supported by the eyepiece 26 of the housing 12. The body 160*a* may include an opening 158 formed therethrough and an elastomeric material 169*a* formed over an outer surface of the body 160*a*. A cover 159*a* may be received generally within the body 160*a* and may be formed from a transparent or translucent material such as, for example, clear plastic. While the cover 159*a* is described as being formed from a clear plastic material, the cover 159*a* may be formed from any material that permits light to pass therethrough and be collected by the fluorescent fiber 152.

A pair of O-ring seals 161 may be disposed generally between the eyepiece 26 and the body 160*a* to prevent intrusion of fluid such as, for example, air and/or water or other debris such as dirt and/or dust into the recess 68. The O-ring seals 161 may be positioned between an inner surface of the cover 159*a* and an outer surface of the eyepiece 26 or, alternatively, may be positioned between an inner surface of the body 160*a* and the outer surface of the eyepiece 26. In either configuration, the O-ring seals 161 provide an air-tight seal between the cover 159*a* and the recess 68 to prevent intrusion of fluid and/or debris into the recess 68. Furthermore, the O-ring seals 161 space the cover 159*a* away from the fiber 152 to prevent contact between the cover 159*a* and the fiber 152.

In either of the above configurations, the width of the opening 158 may be equivalent to or slightly smaller than a width of the coating 141 applied to the fluorescent fiber 152 to allow the rotary dial 156 to substantially prevent or limit light from being collected by the fluorescent fiber 152. For example, if the rotary dial 156 is rotated such that the cover 159 opposes the coating 141, the coating 141 could extend over the fiber 152 a sufficient distance such that the exposed fiber 152 under the cover 159 is completely coated and therefore cannot collect light. The above feature allows a user to substantially completely prevent light collection by the fluorescent fiber 152 by positioning the cover 159 over the coated fiber 152.

As shown in FIG. 1, the rotary dial 156 is rotatably attached to the eyepiece 26 such that the body 160 of the rotary dial 156 selectively covers the recess 68 of the eyepiece 26. Rotation of the rotary dial 156 relative to the eyepiece 26 causes similar rotation of the opening 158 relative to the eyepiece 26. When the rotary dial 156 is positioned such that the body 160 generally covers the recess 68, the body 160 of the rotary dial 156 covers the fluorescent fiber 152 disposed generally within the recess 68. In this position, ambient light is restricted from entering the recess 68 and is therefore restricted from being trapped by the fluorescent fiber 152. In this position, the fluorescent fiber 152 supplies only a limited amount of light to the reticle pattern 22. The limited amount of light supplied to the reticle pattern 22 limits the intensity of illumination of the reticle pattern 22.

To once again permit ambient light into the recess 68, the rotary dial 156 may be rotated relative to the eyepiece 26 until the opening 158 exposes the recess 68 and fluorescent fiber 152. At this position, the opening 158 allows ambient light to travel through the rotary dial 156 and into the fluorescent fiber 152. By allowing ambient light into the recess 68 and, thus, into the fluorescent fiber 152, the rotary dial 156 allows the fluorescent fiber 152 to deliver ambient light to the reticle pattern 22 to illuminate the reticle pattern 22. As noted above, different conditions require different amounts of ambient light to be supplied to the reticle pattern 22. The rotary dial 156 and opening 158 cooperate to allow for infinite adjustment of the ambient light supplied to the reticle pattern 22 via the fluorescent fiber 152. Because the opening 158 may be positioned in virtually any position relative to the recess 68 and fluorescent fiber 152, a user may rotate the rotary dial 156 even miniscule amounts to adjust the amount of ambient light transmitted through the opening 158 and into the fluorescent fiber 152 and may similarly rotate the rotary dial 156 to account for changing ambient light conditions (i.e., transitioning from daytime to dusk, for example) to maintain a constant illumination of the reticle pattern 22. Adjustment of the illumination of the reticle pattern 22 is virtually limitless.

As noted above, the optical gun sight 10 may be used in dark conditions such as at night and/or in a dark building. Under such circumstances, when illumination of the reticle pattern 22 is required, ambient light is not readily accessible and the fluorescent fiber 152 may not be able to sufficiently illuminate the reticle pattern 22 even when the rotary dial 156 is positioned such that the opening 158 completely exposes the fluorescent fiber 152. Under such circumstances, it may be necessary to supplement the light transmitted by the fluorescent fiber 152 to the reticle pattern 22.

The illumination system 18 may also include a light-emitting diode 162 (LED), an electroluminescent film or wire, and/or a Tritium lamp 164 to further supplement the light supplied to the reticle pattern 22 by the fluorescent fiber 152 (FIGS. 6-11). The LED 162 and Tritium lamp 164 are preferably of the type disclosed in Assignee's commonly owned U.S. Pat. Nos. 4,806,007 and 6,807,742, the disclosures of which are incorporated herein by reference. The LED 162, electroluminescent film or wire, and/or Tritium lamp 164 may be controlled by a control module 165 and may include a power source such as a battery 167.

With particular reference to FIGS. 7-11, various illumination devices are shown for use in conjunction with the illumination system 18. The various illumination devices may be used in conjunction with fluorescent fiber 152 to supply the reticle pattern 22 with a sufficient amount of light to illuminate the reticle pattern 22 when there is insufficient ambient light provided to the reticle pattern 22 by the fluorescent fiber 152.

Figure 7:
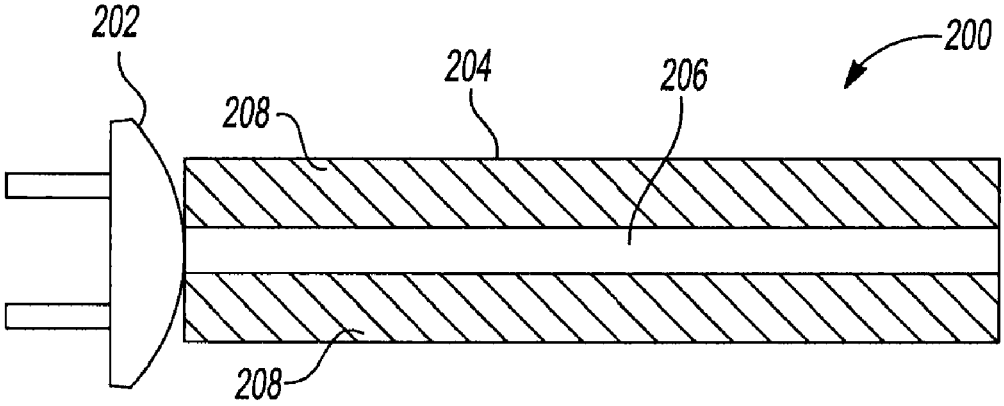
FIG. 7 is a cross-sectional view of an illumination device for use with the optical sight of FIG. 1 including an array of light emitting diodes (LED) associated with a black-jacket fiber.

With reference to FIG. 7, an illumination device 200 is provided and includes an LED 202 and a black-jacket fiber 204. The LED 202 is attached to an end of the black-jacket fiber 204 by a suitable fastener and/or an epoxy. The black-jacket fiber 204 includes a light channel 206 that receives light from the LED 202 and directs the light along a length of the black-jacket fiber 204. Because the black-jacket fiber 204 includes blacked-out walls 208, light from the LED 202 does not escape from the light channel 206 of the black-jacket fiber 204 and, therefore, may be translated along a length of the black-jacket fiber 204 within the light channel 206 without losing a significant amount of light.

The illumination device 200 may be used in conjunction with the fluorescent fiber 152 to illuminate the reticle pattern 22. For example, when using the optical gun sight 10 in dark conditions such that light from the fluorescent fiber 152 is insufficient to properly illuminate the reticle pattern 22, the LED 202 of the illumination device 200 may be energized to provide light to the reticle pattern 22 via the light channel 206 of the black-jacket fiber 204. Light from the illumination device 200 may be combined with light from the fluorescent fiber 152 to illuminate the reticle pattern 22.

Figure 8A:
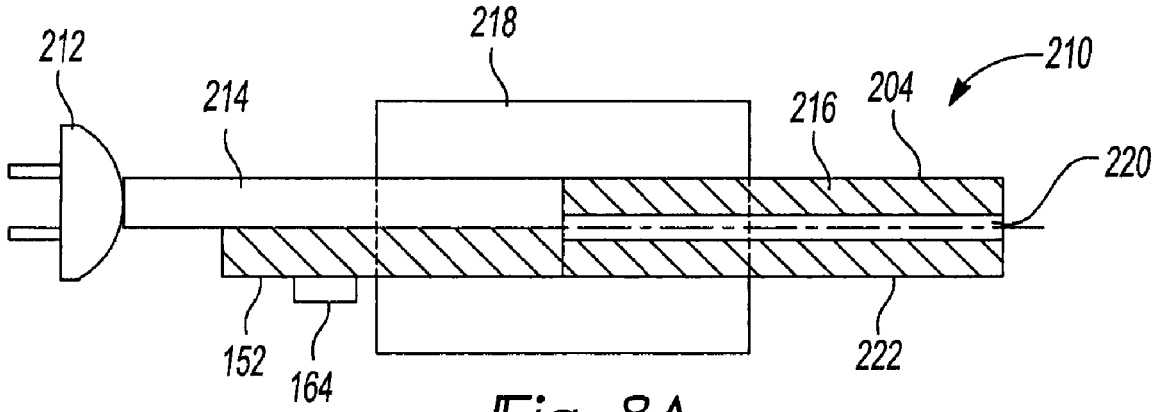
FIG. 8A is a cross-sectional view of an illumination device including an LED associated with a clear fiber and a fluorescent fiber with a Tritium lamp fused together with a black-jacket fiber.

With reference to FIG. 8A, an illumination device 210 is provided and includes an LED 212, a clear fiber 214 that may have a diameter approximately half the diameter of a black-jacket fiber 216 and fluorescent fiber 152 that may have a diameter approximately half the diameter of black-jacket fiber 216. The LED 212 is attached to the clear fiber 214 by a suitable fastener and/or an epoxy. The clear fiber 214 and the fluorescent fiber 152 may be fused together with UV glue and then inserted into a coupler 218. The coupler 218 may be a polycarbonate coupler including an inner diameter that receives the clear fiber 214 and the fluorescent fiber 152. The black-jacket fiber 216 may be abutted to ends of both the clear fiber 214 and the fluorescent fiber 152 by a suitable fastener and/or an epoxy. The coupler 218 is used to properly position the clear fiber 214 and fluorescent fiber 152 relative to the black-jacket fiber 216.

The black-jacket fiber 216 includes a light channel 220 extending along a length of the black-jacket fiber 216 and blacked-out walls 222.

In operation, light from the LED 212 is transmitted along a length of the clear fiber 214 and may be received within the light channel 220 of the black-jacket fiber 216. The black-jacket fiber 216 may then direct light from the LED 212 to the reticle pattern 22 to illuminate the reticle pattern 22. However, if there is sufficient ambient light to allow the fluorescent fiber 152 to illuminate the reticle pattern 22, the fluorescent fiber 152 will direct light through the light channel 220 of the black-jacket fiber 216 such that the reticle pattern 22 is illuminated by light from the fluorescent fiber 152. A Tritium lamp 164 may be attached to the fluorescent fiber 152 and may be used in conjunction with the LED 212 and/or fluorescent fiber 152 or, alternatively, may be used independently of the LED 212 and fluorescent fiber 152 to illuminate the light channel 220.

The black-jacket fiber 216 collimates the output from the coupled fibers (i.e., the fluorescent fiber 152 and clear fiber 214) to either illuminate the reticle pattern 22 using light from the LED 212 and clear fiber 214 or using light from the fluorescent fiber 152. As described above, the black-jacket fiber 216 will illuminate the reticle pattern 22 using either light from the clear fiber 214 or fluorescent fiber 152, depending on which light source includes a greater illumination. Coupling the clear fiber 214 and fluorescent fiber 152 in the manner previously described eliminates forward illumination of the fluorescent fiber 152. Specifically, this coupling technique prevents unwanted light from clear fiber 214 (when illuminated by the LED 212) from being absorbed by the fluorescent fiber 152 and hence eliminates forward illumination of the fluorescent fiber 152. Such forward illumination is undesirable in tactical operation, for example, as it may reflect light and identify a user's location.

Figure 8B:
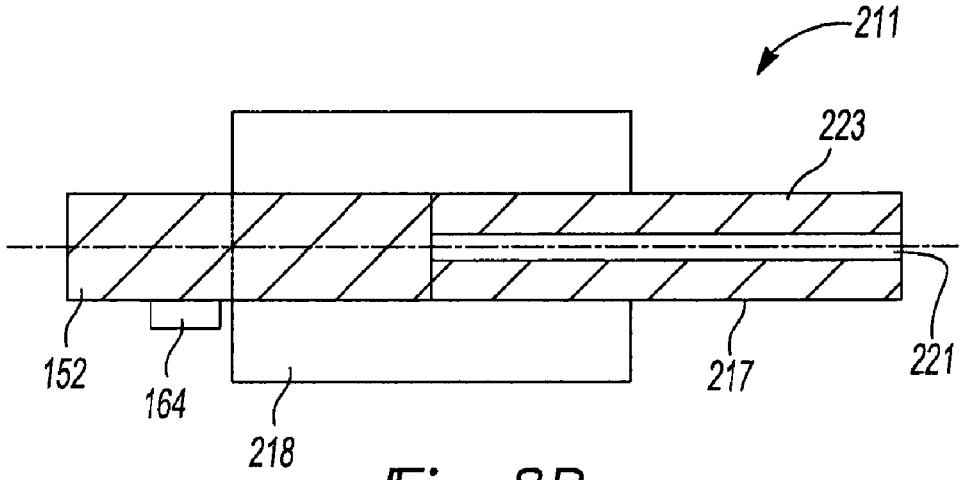
FIG. 8B is a cross-sectional view of an illumination device including a fluorescent fiber and a Tritium lamp fused together with a black-jacket fiber.

With reference to FIG. 8B, an illumination device 211 is provided and includes a black-jacket fiber 217, a coupler 218, and fluorescent fiber 152. The fluorescent fiber 152 may have a diameter approximately equal to the diameter of black-jacket fiber 217 and may selectively supply light to the black-jacket fiber 217. The coupler 218 may be a polycarbonate coupler including an inner diameter that receives the fluorescent fiber 152. The black-jacket fiber 217 may be abutted to an end of both the fluorescent fiber 152 by a suitable fastener and/or an epoxy. The coupler 218 may be used to properly position the fluorescent fiber 152 relative to the black-jacket fiber 217.

The black-jacket fiber 217 includes a light channel 221 extending along a length of the black-jacket fiber 217 and blacked-out walls 223.

In operation, light from the fluorescent fiber 152 may be received within the light channel 221 of the black-jacket fiber 217. The black-jacket fiber 217 may then direct light from the fiber 152 to the reticle pattern 22 to illuminate the reticle pattern 22. A Tritium lamp 164 may be attached to the fluorescent fiber 152 and may be used in conjunction with the fluorescent fiber 152.

The black-jacket fiber 217 may collimate the output from the coupled fluorescent fiber 152 and the Tritium lamp 164 if each light source is providing light to the black-jacket fiber 217. The black-jacket fiber 217 will illuminate the reticle pattern 22 using light provided by the fiber 152 and/or Tritium lamp 164.

Figure 9:
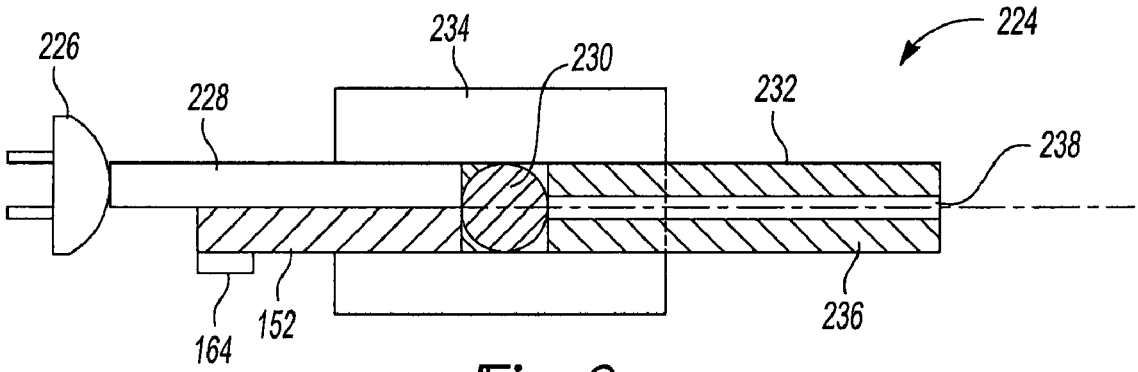
FIG. 9 is a cross-sectional view of an illumination device for use with the optical sight of FIG. 1 including an LED coupled to a clear fiber fused with a fluorescent fiber with a Tritium lamp and including a ball lens directing light from the clear fiber and fluorescent fiber towards a black-jacket fiber.

With reference to FIG. 9, an illumination device 224 is provided and includes an LED 226, a clear fiber 228, a ball lens 230, and a black-jacket fiber 232. The LED 226 is attached to the clear fiber 228 by a suitable fastener and/or an epoxy such that light from the LED 226 is received by and directed along a length of the clear fiber 228. The clear fiber 228 is coupled to the fluorescent fiber 152 by a coupler 234 such that the clear fiber 228 is disposed adjacent to the fluorescent fiber 152. Both clear fiber 214 and fluorescent fiber 152 may have a diameter half of the black-jacket fiber 232. The diameter of the ball lens 230 may be the same as the black-jacket fiber 232. As described above with respect to the illumination device 210, the coupler 234 may similarly be a machined polycarbonate coupler.

The ball lens 230 may be abutted to both the clear fiber 228 and the fluorescent fiber 152. Output from the fibers 152, 228 is collimated by the ball lens to permit light from the clear fiber 228 and LED 226 or from the fluorescent fiber 152 solely to pass through the ball lens 230 based on whichever light source (i.e., ambient versus LED 226) is greater. For example, if ambient light conditions are low such that the LED 226 is greater than the ambient light collected by the fluorescent fiber 152, the ball lens 230 will direct light from the LED 226 and clear fiber 228 through the ball lens 230 rather than directing light from the fluorescent fiber 152. The ball lens 230 collimates light from the clear fiber 228 and fluorescent fiber 152 due to internal reflection of such light within the round ball lens 230.

The ball lens 230 may be a clear ball lens with a refractive index substantially greater than 1.9. The ball lens 230 may have an anti-reflective (AR) coating that may match a range of wavelengths generated by the LED 226 and the fluorescent fiber 152. This anti-reflective coating may eliminate forward illumination of the fluorescent fiber 152. The ball lens 230, in addition to being attached to the clear fiber 228 and fluorescent fiber 152, may also be attached to the coupler 234 and to the black-jacket fiber 232. A Tritium lamp 164 may be attached to the fluorescent fiber 152 and may be used in conjunction with the LED 226 and/or fluorescent fiber 152 or, alternatively, may be used independently of the LED 226 and fluorescent fiber 152 to illuminate the light channel 238.

Depending on the intensity of the light received from the clear fiber 228 and the fluorescent fiber 152, the ball lens 230 will direct light through the ball lens 230 and into the black-jacket fiber 232. The black-jacket fiber 232 includes blacked-out walls 236 and a light channel 238 that cooperates to direct light from either the LED 226 or the fluorescent fiber 152 towards the reticle pattern 22 to illuminate the reticle pattern 22.

Figure 10:
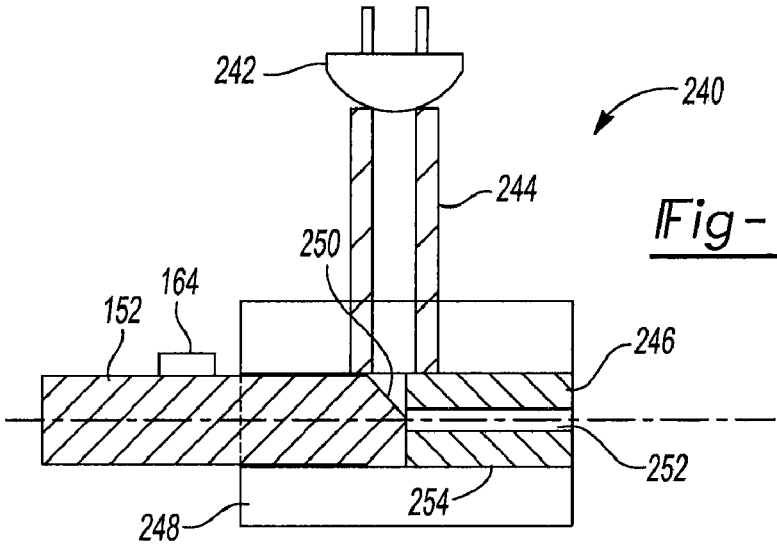
FIG. 10 is a cross-sectional view of an illumination device for use with the optical sight of FIG. 1 including an LED associated with a clear fiber and a fluorescent fiber with a Tritium lamp that supplies light to a black-jacket fiber via the clear fiber and/or fluorescent fiber.

With reference to FIG. 10, an illumination device 240 is provided and includes an LED 242, a fiber 244 attached to the LED 242 by a fastener and/or an epoxy, a black-jacket fiber 246, and a coupler 248. The coupler 248 joins the fiber 244, black-jacket fiber 246, and fluorescent fiber 152. The diameter of the fluorescent fiber 152 may be identical to the diameter of the black-jacket fiber 246.

The LED 242 supplies light to the fiber 244, which is directed by the fiber 244 generally towards a junction of the fluorescent fiber 152 and the black-jacket fiber 246 within the coupler 248. The fluorescent fiber 152 includes an end having an inclined surface 250 that receives light from the LED 242 via fiber 244 and directs the light towards the black-jacket fiber 246. The black-jacket fiber 246 includes a light channel 252 and blacked-out walls 254. Light received from the inclined surface 250 of the fluorescent fiber 152 is directed through the light channel 252 of the black-jacket fiber 246 and is contained within the light channel 252 by the blacked-out walls 254 of the black-jacket fiber 246.

The inclined surface 250 reflects light from the LED 242 via fiber 244 to the black-jacket fiber 246 or directs the light from the fluorescent fiber 152 towards the black-jacket fiber 246. Therefore, light from the LED 242 is transmitted through the light channel 252 of the black-jacket fiber 246 if light from the LED 242 is greater than light from the fluorescent fiber 152. However, if there is sufficient ambient light to allow the fluorescent fiber 152 to illuminate the reticle pattern 22, the fluorescent fiber 152 will direct light through the light channel 252 of the black-jacket fiber 246. The light is contained generally within the black-jacket fiber 246 due to the blacked-out walls 254 of the black-jacket fiber 246 and is directed towards the reticle pattern 22 to illuminate the reticle pattern 22. A Tritium lamp 164 may be attached to the fluorescent fiber 152 and may be used in conjunction with the LED 242 and/or fluorescent fiber 152 or, alternatively, may be used independently of the LED 242 and fluorescent fiber 152 to illuminate the light channel 252.

Figure 11A:
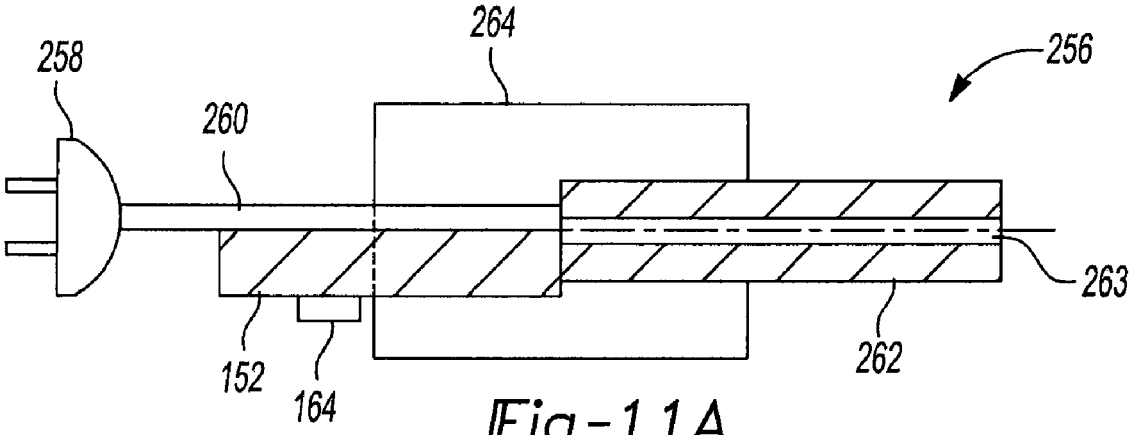
FIG. 11A is an illumination device for use with the optical sight of FIG. 1 including an LED coupled to a clear fiber and a fluorescent fiber that directs light through the clear fiber and fluorescent fiber with a Tritium lamp to a black-jacket fiber.
Figure 11B:
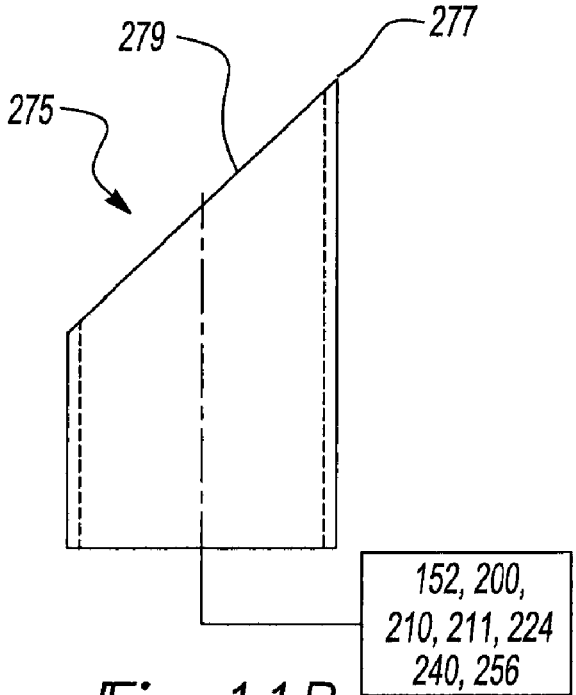
FIG. 11B is a side view of a fiber post for use with an illumination device in accordance with the principals of the present disclosure.
Figure 11C:
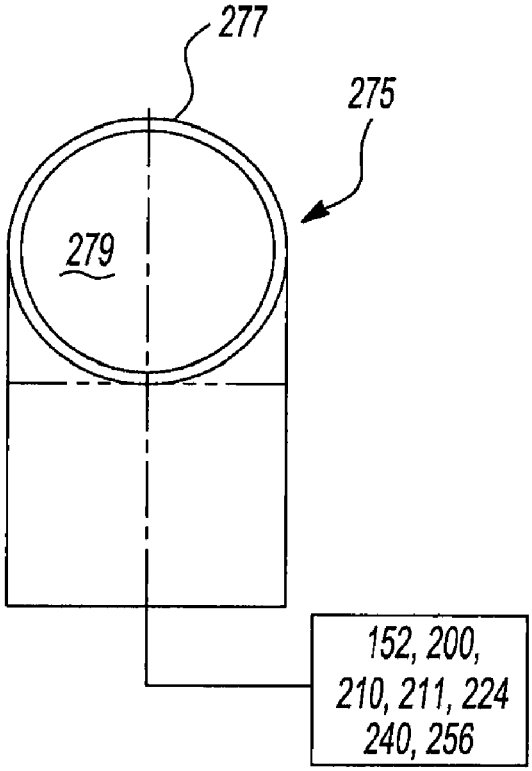
FIG. 11C is a front view of a fiber post for use with an illumination device in accordance with the principals of the present disclosure.
Figure 11D:
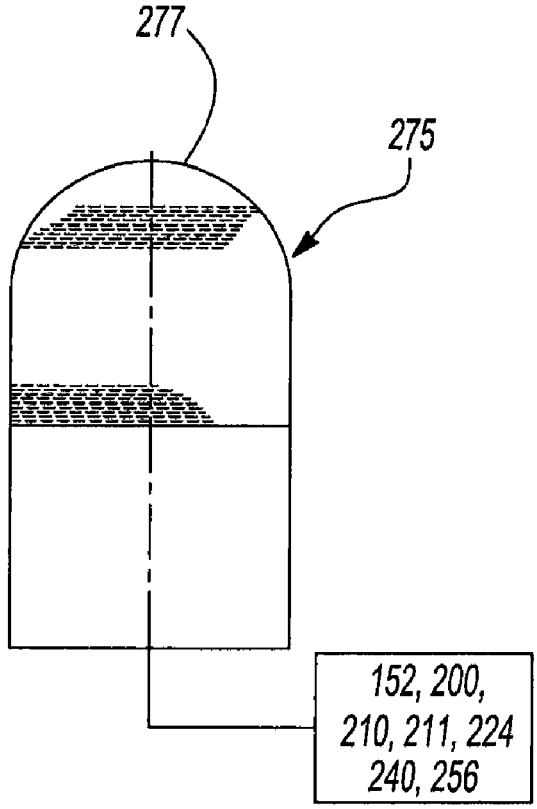
FIG. 11D is a rear view of a fiber post for use with an illumination device in accordance with the principals of the present disclosure.
Figure 11E:
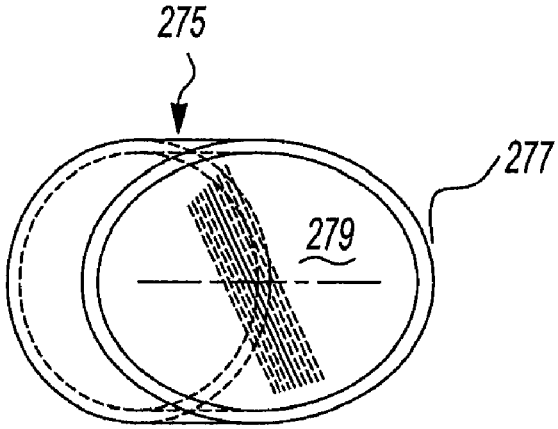
FIG. 11E is a top view of a fiber post for use with an illumination device in accordance with the principals of the present disclosure.

With particular reference to FIG. 11A, an illumination device 256 is provided and includes an LED 258, a clear fiber 260, a black-jacket fiber 262 including a light channel 263, and a coupler 264. The LED 258 is attached to the clear fiber 260 by a fastener and/or an epoxy and provides the clear fiber 260 with light. The clear fiber 260 is joined to the fluorescent fiber 152 by coupler 264. Output from the clear fiber 260 and the fluorescent fiber 152 is directed to the black-jacket fiber 262 to illuminate the reticle pattern 22.

The coupler 264 includes two offset holes that may be machined or molded. These offset holes arrange the three fibers (clear fiber 260, fluorescent fiber 152 and black-jacket fiber 262) in such a way that approximately 50% of the light transmitted through light channel 263 comes from clear fiber 260 and the rest comes from the fluorescent fiber 152. The fluorescent fiber 152 includes a larger diameter than the clear fiber 260, which allows the fluorescent fiber 152 to absorb more ambient light and more brightly illuminate the reticle pattern 22. With the exception of the diameters of the clear fiber 260, coupler 264 and the fluorescent fiber 152, the illumination device 256 is similar to the illumination device 210 (FIG. 8). Therefore, a detailed description of the operation of the illumination device 256 is foregone.

As described above, the various illumination devices 200, 210, 211, 224, 240, 256 may be used to supply the reticle pattern 22 with a sufficient amount of light to illuminate the reticle pattern 22, regardless of ambient conditions. In each of the foregoing illumination devices 200, 210, 211, 224, 240, 256, light from the LED 202, 212, 226, 242, 258 or from the fluorescent fiber 152 is directed to the reticle pattern 22 to illuminate the reticle pattern 22. In each of the devices 200, 210, 211, 224, 240, 256, light is transmitted from the light source to the reticle pattern 22 by the light channel 206, 220, 221, 238, 252, 263. While the fibers 204, 216, 217, 232, 246, 262 are described as black-jacket fibers, the fibers 204, 216, 217, 232, 246, 262 may be any suitable fiber that adequately transmits light from the light source to the reticle pattern 22. The fibers 204, 216, 217, 232, 246, 262 of the respective illumination devices 200 or 211, 210, 211, 224, 240, 256 are positioned relative to the reticle pattern 22 such that light from the light source is directed from the light channel 206, 220, 221, 238, 252 and 263 generally towards the center of the reticle pattern 22. While light from the illumination devices 200, 210, 211, 224, 240, 256 is generally sufficient to illuminate a center-aiming point 274 (FIGS. 20, 23, 34, 36, and 40) of the reticle pattern 22, a secondary light source may be positioned proximate to the reticle pattern 22 to further enhance and illuminate the entire reticle pattern 22 or at least a portion of the reticle pattern 22.

With reference to FIGS. 11B-11E, the fluorescent fiber 152 and various illumination devices 200, 210, 211, 224, 240, 256 may also be coupled to a fiber post 275 to illuminate a center-aiming point 274 if the center-aiming point 274 is not etched in the prism 88. For example, the fiber post 275 may be an elongate fiber having a specified shape at a distal end 277 thereof. In one configuration, the distal end 277 of the fiber post 275 includes an inclined surface 279 (i.e., a "D" shape—FIGS. 11C and 11E) such that light received from the particular illumination device 200, 210, 211, 224, 240, 256 illuminates the inclined surface 279 to create the center-aiming point 274. In another configuration, the inclined surface 279 may include a pair of inclined surfaces. In either configuration, the fiber post 275 may be of the type discloses in assignee's commonly owned U.S. Pat. No. 5,924,234, the disclosure of which is incorporated herein by reference.

If the fluorescent fiber 152 is connected to the fiber post 275, the fiber 152 may be attached at an opposite end of the fiber post 275 from the distal illuminated end 277. If one of the illumination devices 200, 210, 211, 224, 240, 256 is attached to the fiber post 275, the fiber 204, 216, 217, 232, 246, 262 of the respective illumination device 200, 210, 211, 224, 240, 256 may similarly be attached at an opposite end of the fiber post 275 from the distal illuminated end 277.

With particular reference to FIGS. 12-39, a series of illumination devices including an electroluminescent element (i.e., LED, electroluminescent film, etc.) are provided for use in conjunction with the output from the fibers 204, 216, 217, 232, 246, 262 of the illumination devices 200, 210, 211, 224, 240, 256 to illuminate the reticle pattern 22. While the illumination devices of FIGS. 12-39 may be used in conjunction with any of the fibers 204, 216, 217, 232, 246, 262 of the illumination devices 200, 210, 211, 224, 240, 256, the illumination devices of FIGS. 12-39 will be described hereinafter and shown in the drawings as being associated with the fiber 204 of the illumination device 200 for the sake of convenience.

Figure 12:
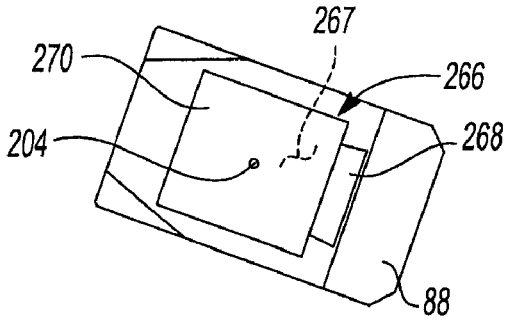
FIG. 12 is a top view of a prism assembly incorporating an illumination device for use with the optical sight of FIG. 1 including an LED and an optical device having a light-scattering surface.
Figure 13:
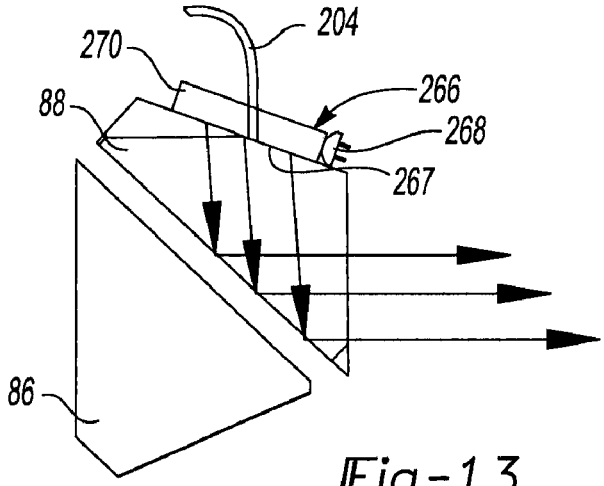
FIG. 13 is a cross-sectional view of the prism assembly and illumination device of FIG. 12.

With reference to FIGS. 12 and 13, an illumination device 266 is provided and includes an LED 268 and an optical device 270. The LED 268 is attached to one or both of the optical device 270 and the mirror prism 88 and supplies the optical device 270 with light. The optical device 270 may be an optical plastic device and may include a distressed surface 267 that evenly disperse light from the LED 268 toward the mirror prism 88.

Cooperation between the LED 268 and optical device 270 provides the mirror prism 88 with sufficient light and over a sufficient area of the mirror prism 88 to fully illuminate the reticle pattern 22 including stadia lines 272 (FIGS. 20, 23, 34, 36 and 40), as well as the center-aiming point 274 (FIGS. 20, 23, 34, 36, and 40). As shown in FIG. 13, the fiber 204 from the illumination device 200 is centered generally over the center-aiming point 274 of the mirror prism 88. Therefore, light from the fiber 204 is directed generally toward the center-aiming point 274 and does not sufficiently illuminate the entire reticle pattern 22 including the stadia lines 272. Because the optical device 270 includes a shape that substantially covers the entire reticle pattern 22, light from the LED 268 is scattered throughout the optical device 270 and sufficiently illuminates the entire reticle pattern 22, including both the stadia lines 272 and the center-aiming point 274 of the reticle pattern 22.

Figure 14:
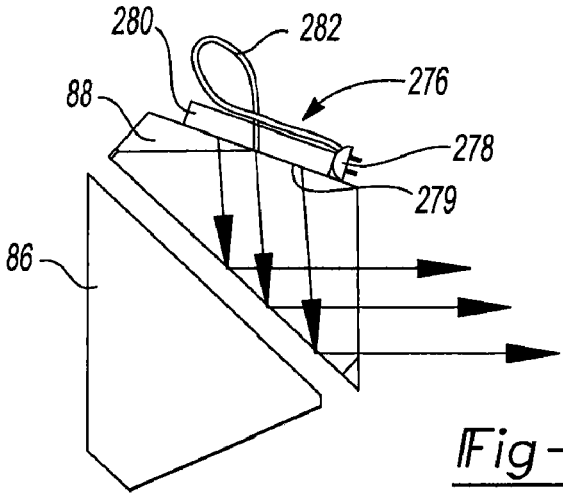
FIG. 14 is a cross-sectional view of a prism assembly and illumination device for use with the optical sight of FIG. 3 including an optical fiber fused to an LED.

With reference to FIG. 14, an illumination device 276 is provided and includes an LED 278, an optical device 280, and a fiber 282. The LED 278 may be attached to one of the optical device 280 and the mirror prism 88 and supplies the optical device 280 with light. The optical device 280 may include a distressed surface 279 that evenly disperses light emitted from the LED 278 toward the mirror prism 88 to fully illuminate the reticle pattern 22 including the stadia lines 272 and center-aiming point 274. The fiber 282 may be attached to the LED 278 such that stray light from the LED 278 is captured by the fiber 282 and directed generally towards the mirror prism 88 and reticle pattern 22. An output of the fiber 282 may be positioned generally above the center-aiming point 274 to further illuminate the center-aiming point 274 and may be combined with light from the fiber 204 of the illumination device 200.

Figure 15:
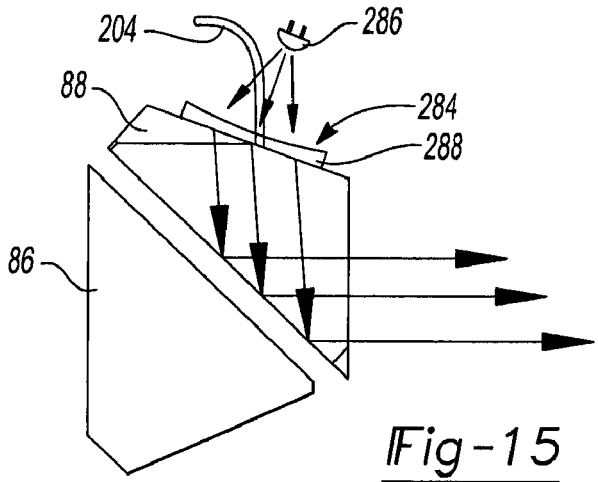
FIG. 15 is a cross-sectional view of a prism assembly and illumination device for use with the optical sight of FIG. 3 including a plano-concave lens, an optical fiber and an LED.

With reference to FIG. 15, an illumination device 284 is provided and includes an LED 286 and an optical device 288. The LED 286 is spaced apart from the optical device 288 such that light from the LED 286 is directed towards and received by the optical device 288. The optical device 288 is attached to the mirror prism 88 and may include a piano-concave lens that increases the focal distribution of emitted light from the LED 286 across the entire reticle pattern 22. As described above with respect to the illumination devices 266, 276, illuminating the entire reticle pattern 22 allows for illumination of the stadia lines 272 and center-aiming point 274. The center-aiming point 274 may further be illuminated by the fiber 204 of the illumination device 200.

Figure 16:
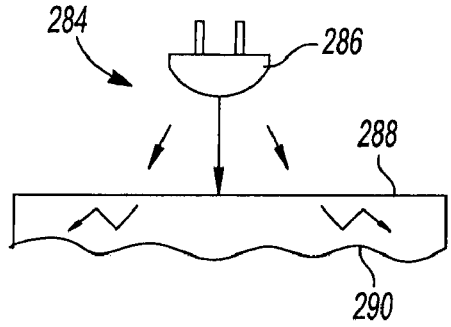
FIG. 16 is a cross-sectional view of an illumination device for use with the optical sight of FIG. 3 including a Fresnel lens, a light-scattering surface, an optical fiber, and an LED.

While the optical device 288 is described as being a piano-concave lens, the optical device 288 could alternatively include a generally flat lens having a light-scattering distressed surface 290 (FIG. 16). The distressed surface 290 receives light from the LED 286 and scatters the light across the entire reticle pattern 22 to fully illuminate the stadia lines 272 and center-aiming point 274. As with the illumination device 284 of FIG. 15, the optical device 288, including the distressed surface 290, may be used in conjunction with the fiber 204 of the illumination device 200.

Figure 17:
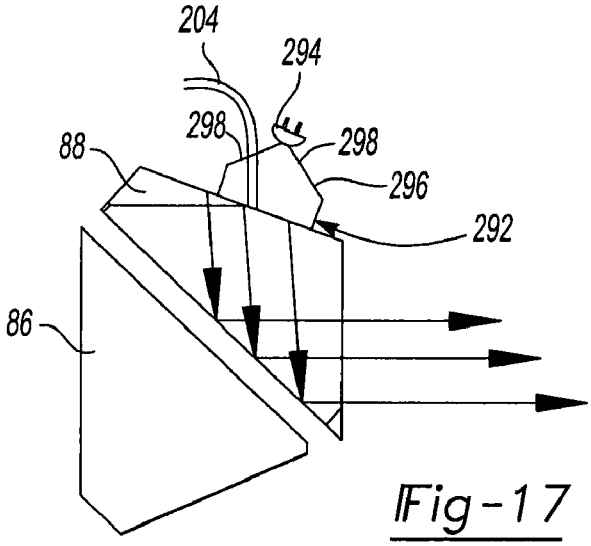
FIG. 17 is a cross-sectional view of a prism incorporating an illumination device for use with the optical sight of FIG. 3 including a laser-line generator lens, an optical fiber and an LED.
Figure 18:
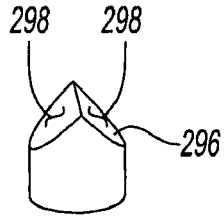
FIG. 18 is a perspective view of the laser-line generator lens of FIG. 17.

With reference to FIGS. 17 and 18, an illumination device 292 is provided and includes an LED 294 and a lens 296. The LED 294 may be attached to the lens 296 such that light from the LED 294 is received by the lens 296. The lens 296 may be attached to the mirror prism 88 and includes a pair of angled surfaces 298 that direct light from the LED 294 through the lens 296 and generally towards the reticle pattern 22 formed on the mirror prism 88.

The illumination device 292 may be used in conjunction with the illumination device 200 such that the fiber 204 or 223 of the illumination device 200 is received generally through the lens 296 to directly illuminate the center-aiming point 274. Light from the LED 294 may be used in conjunction with the fiber 204 of the illumination device 200 to fully illuminate the reticle pattern 22 including the stadia lines 272 and the center-aiming point 274.

Figure 19:
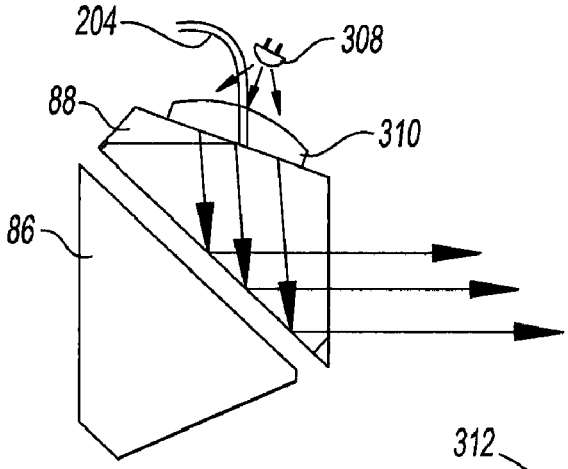
FIG. 19 is a cross-sectional view of a prism assembly incorporating an illumination device for use with the optical sight of FIG. 3 including a convex lens, an LED and an optical fiber.

With reference to FIG. 19, an illumination device 306 is provided and includes an LED 308 and an optical device 310. The LED 308 is spaced apart from the optical device 310 and supplies the optical device 310 with light. The optical device 310 is attached to the mirror prism 88 and may be a convex lens that increases the focal distribution of emitted light from the LED 308 across the entire reticle pattern 22. As described above with regard to the illumination device 266, directing light across the entire reticle pattern 22 illuminates the stadia lines 272 and center-aiming point 274 of the reticle pattern 22. The center-aiming point 274 may further be illuminated by the fiber 204 of the illumination device 200.

Figure 20:
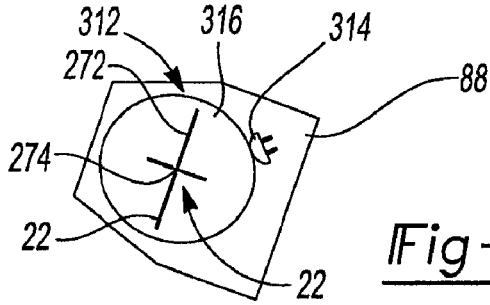
FIG. 20 is a top view of a prism assembly including an LED associated with a diffuse glass.
Figure 21:
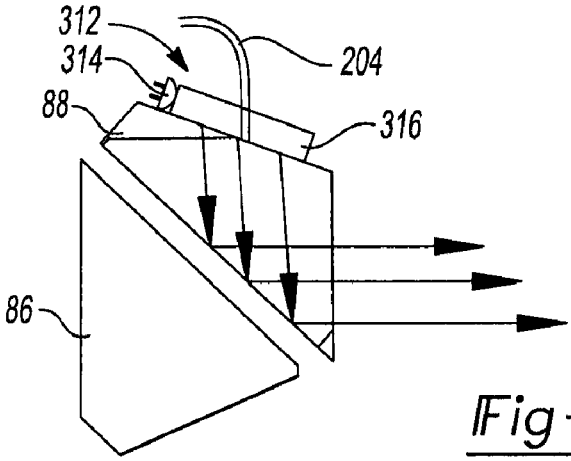
FIG. 21 is a cross-sectional view of the prism assembly and illumination device of FIG. 20 including an LED and an optical fiber.

With reference to FIGS. 20 and 21, an illumination device 312 is provided and includes an LED 314 and an optical device 316. The LED 314 may be attached to the optical device 316 and/or to the mirror prism 88. The LED 314 supplies light to the optical device 316 to illuminate the reticle pattern 22 including the stadia lines 272 and center-aiming point 274.

The optical device 316 may be a glass diffuser that disperses light emitted from the LED 314 across the entire reticle pattern 22. Outside surfaces of the optical device 316 may be painted with a reflective coating to aid in internal reflectivity. The illumination device 312 may be used in conjunction with the illumination device 200 to permit the fiber 204 of the illumination device 200 to further illuminate the center-aiming point 274.

Figure 22:
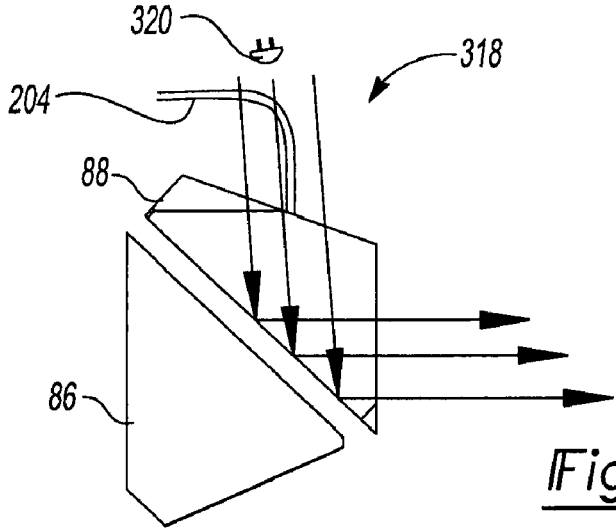
FIG. 22 is a cross-sectional view of a prism assembly and illumination device for use with the optical sight of FIG. 3 including an LED mounted a predetermined distance away from the prism assembly and an optical fiber attached to an LED.

With reference to FIG. 22, an illumination device 318 is provided and includes an LED 320 spaced apart from the mirror prism 88 a predetermined distance to allow light from the LED 320 to fully illuminate the reticle pattern 22 including the stadia lines 272 and the center-aiming point 274. The illumination device 318 may be used in conjunction with the illumination device 200 such that the fiber 204 of the illumination device 200 is directed towards the center-aiming point 274 to further illuminate the center-aiming point 274.

Figure 23:
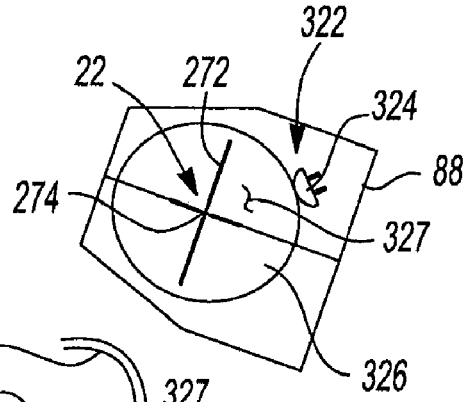
FIG. 23 is a top view of a prism assembly and illumination device for use with the optical sight of FIG. 3 including an LED and a glass mirror top and side diffuser.
Figure 24:
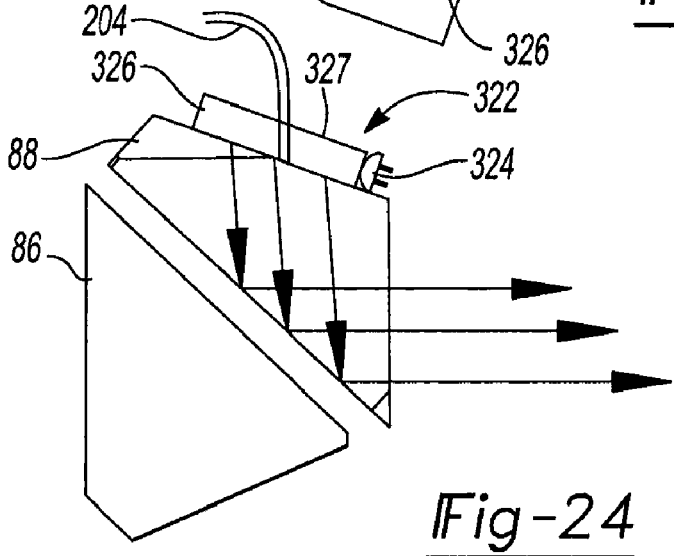
FIG. 24 is a cross-sectional view of the prism assembly and illumination device of FIG. 23 with an optical fiber.

With reference to FIGS. 23 and 24, an illumination device 322 is provided and includes an LED 324 and an optical device 326. The LED 324 may be attached to the optical device 326 and/or to the mirror prism 88 and provides the optical device 326 with light to illuminate the reticle pattern 22. The optical device 326 may be a glass diffuser with a mirrored top surface 327 that evenly disperses light emitted from the LED 324 toward the reticle pattern 22. Outside surfaces of the optical device 326 may be painted with a reflective coating to aid in internal reflectivity of the optical device 326. The illumination device 322 may be used in conjunction with the illumination device 200 to permit the fiber 204 of the illumination device 200 to further illuminate the center-aiming point 274.

Figure 25:
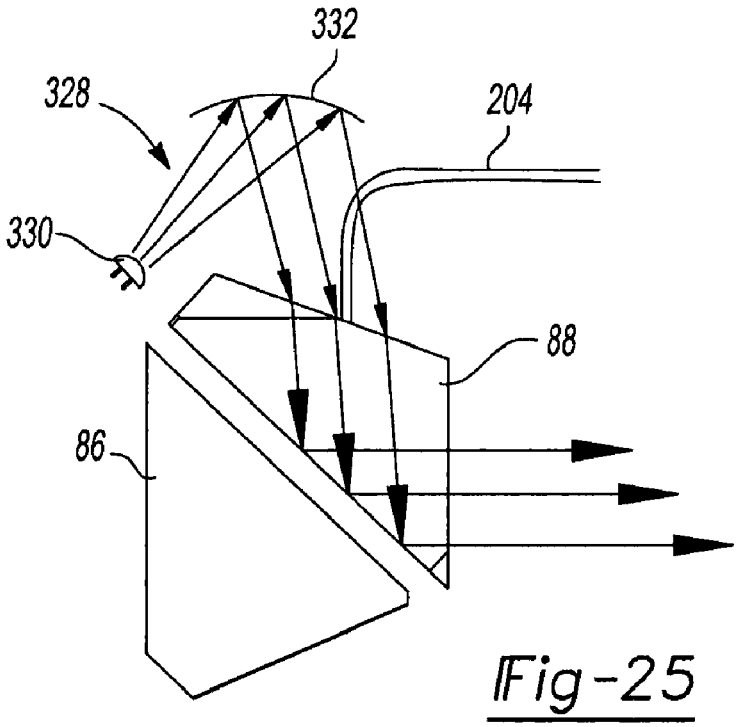
FIG. 25 is a cross-sectional view of a prism assembly and illumination device for use with the optical sight of FIG. 3 including an optical fiber, an LED and a reflector directing light from the LED towards the prism assembly.

With reference to FIG. 25, an illumination device 328 is provided and includes an LED 330 and a reflector 332. The LED 330 is spaced apart from the reflector 332 and supplies the reflector 332 with light to illuminate the reticle pattern 22. The reflector 332 may include a concave shape to direct light received from the LED 330 generally towards the mirror prism 88 to illuminate the reticle pattern 22. The illumination device 328 may be used in conjunction with the illumination device 200 to allow the fiber 204 of the illumination device 200 to illuminate the center-aiming point 274.

Figure 26:
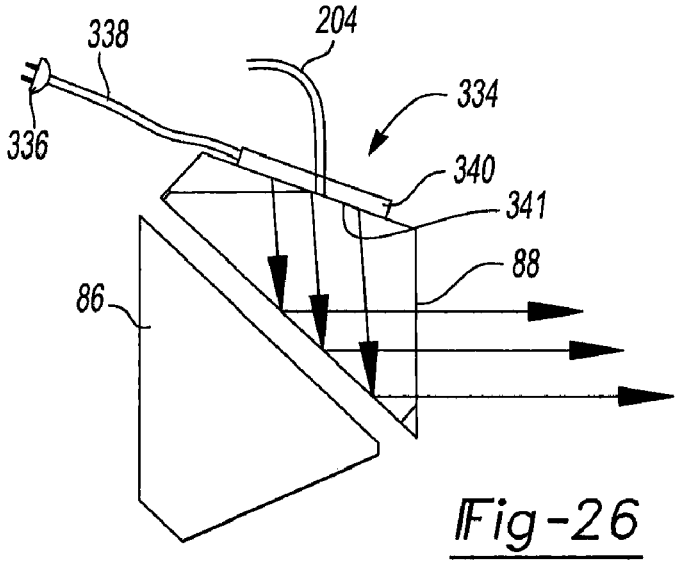
FIG. 26 is a cross-sectional view of a prism assembly and illumination device for use with the optical sight of FIG. 3 including an optical fiber and a lens receiving light from an LED via a fiber.

With reference to FIG. 26, an illumination device 334 is provided and includes an LED 336, a fiber 338, and an optical device 340. The LED 336 is attached to the fiber 338, which directs light from the LED 336 generally towards the optical device 340. The optical device 340 receives light from the LED 336 via fiber 338 and directs the light generally towards the reticle pattern 22 to illuminate the stadia lines 272 and center-aiming point 274. The optical device 340 may be formed of glass or plastic and may include any shape, as well as a roughened surface 341 to evenly distribute light from the LED 336 across the entire reticle pattern 22. The illumination device 334 may be used in conjunction with the illumination device 200 to allow the fiber 204 of the illumination device 200 to illuminate the center-aiming point 274.

Figure 27:
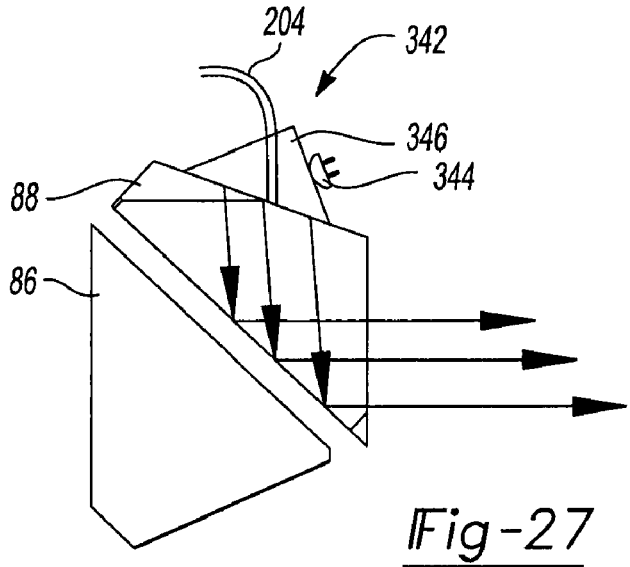
FIG. 27 is a cross-sectional view of a prism assembly and illumination device for use with the optical sight of FIG. 3 including an optical fiber, a right-angle prism and an LED.

With reference to FIG. 27, an illumination device 342 is provided and includes an LED 344 and a right-angle prism 346. The LED 344 may be attached to the right-angle prism 346 while the right-angle prism 346 may be attached to the mirror prism 88. The LED 344 supplies light to the right-angle prism 346 to allow the right-angle prism 346 to direct light across an entire area of the reticle pattern 22. Four sides of the right-angle prism 346 may include a mirror coating to enhance internal reflectivity of the right-angle prism 346 to ensure that most of the light received by the right-angle prism 346 from the LED 344 is directed to the reticle pattern 22.

The right-angle prism 346 may include a mask to allow light from the LED 344 to enter the right-angle prism 346. Light from the right-angle prism 346 is received by the mirror prism 88 to allow full illumination of the reticle pattern 22 including the stadia lines 272 and center-aiming point 274. The illumination device 342 may be used in conjunction with the illumination device 200 such that the fiber 204 of the illumination device 200 is permitted to illuminate the center-aiming point 274.

Figure 28:
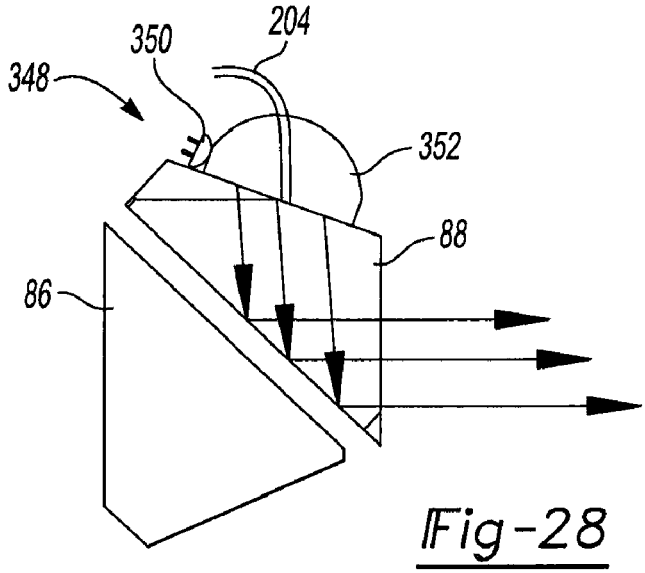
FIG. 28 is a cross-sectional view of a prism assembly and illumination device for use with the optical sight of FIG. 3 including an optical fiber, a half-ball lens and an LED.

With reference to FIG. 28, an illumination device 348 is provided and includes an LED 350 and an optical device 352. The LED 350 may be attached to the half ball lens 352 and/or to the mirror prism 88 and provides light to the half ball lens 352 for use by the optical device 352 in illuminating the reticle pattern 22. The optical device 352 may be a half-ball lens that evenly disperses the light emitted from the LED 350 and may include outside surfaces that are painted with a reflective coating to aid in internal reflectivity of the half ball lens 352. The half ball lens 352 includes a sufficient size to allow light received from the LED 350 to fully illuminate the reticle pattern 22 including the stadia lines 272 and center-aiming point 274. The illumination device 348 may be used in conjunction with the illumination device 200 to allow the fiber 204 of the illumination device 200 to further illuminate the center-aiming point 274.

Figure 29:
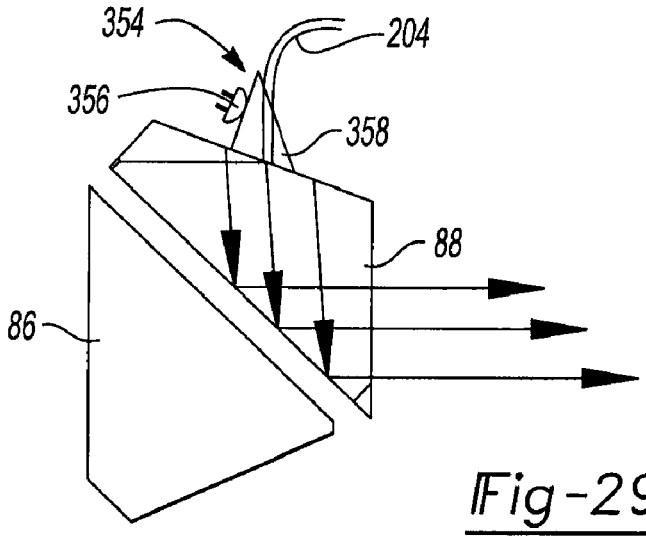
FIG. 29 is a cross-sectional view of a prism assembly and illumination device for use with the optical sight of FIG. 3 including an optical fiber, a right-angle prism and an LED.

With reference to FIG. 29, an illumination device 354 is provided and includes an LED 356 and a right angle prism 358. The LED 356 may be attached to the right angle prism 358 and provides the right angle prism 358 with light for use by the right angle prism 358 in illuminating the reticle pattern 22. The right angle prism 358 may be attached to the mirror prism 88. Four sides of the right angle prism 358 may include a mirror coating to increase the internal reflectivity of the right angle prism 358 to ensure that light from the LED 356 is directed toward the reticle pattern 22. A side of the right angle prism 358 in contact with the LED 356 may include a mask to allow light from the LED 356 to enter the right angle prism 358. The illumination device 354 may be used in conjunction with the illumination device 200 to allow the fiber 204 of the illumination device 200 to illuminate the center-aiming point 274.

Figure 30:
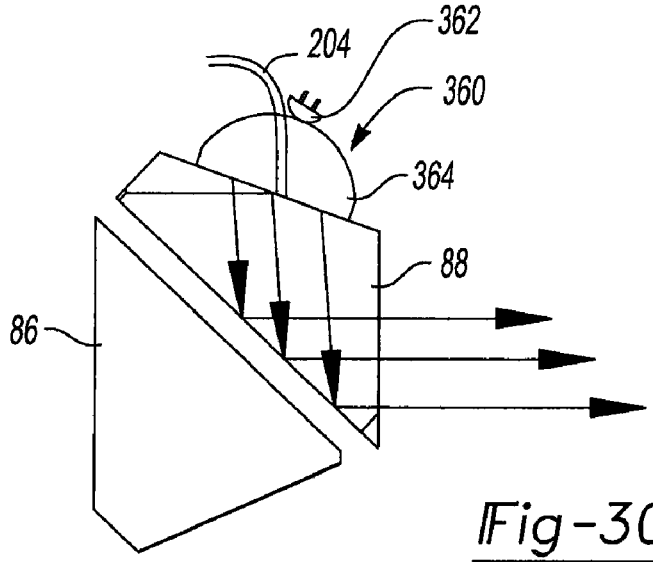
FIG. 30 is a cross-sectional view of a prism assembly and illumination device for use with the optical sight of FIG. 3 including an optical fiber, a half-ball lens and an LED.

With reference to FIG. 30, an illumination device 360 is provided and includes an LED 362 and an half ball lens 364. The LED 362 may be attached to the half ball lens 364 and may supply the half ball lens 364 with light to illuminate the reticle pattern 22. The half ball lens 364 may be attached to the mirror prism 88 to direct light from the LED 362 toward the reticle pattern 22. The optical device 364 may be one-half of a ball lens that evenly disperses light from the LED 362 toward the reticle pattern 22. Outside surfaces of the half-ball lens may be painted with a reflective coating to aid in internal reflectivity. The illumination device 360 may be used in conjunction with the illumination device 200 such that the fiber 204 of the illumination device 200 illuminates the center-aiming point 274.

Figure 31:
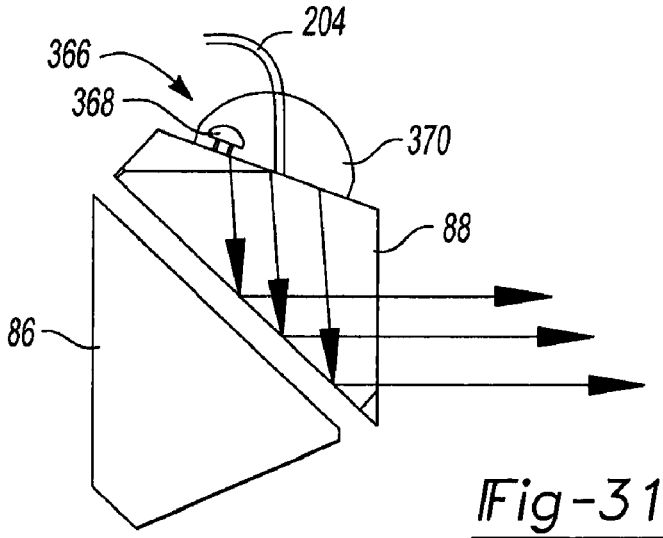
FIG. 31 is a cross-sectional view of a prism assembly and illumination device for use with the optical sight of FIG. 3 including an optical fiber, a parabolic mirror and an LED.

With reference to FIG. 31, an illumination device 366 is provided and includes an LED 368 and an optical device 370. The LED 368 may be face mounted to the mirror prism 88 with light directed away from the mirror prism 88 generally towards the optical device 370. The optical device 370 may be a parabolic mirror, spherical mirror, or concave spherical mirror that evenly distributes and expands the light ray path to evenly illuminate the reticle pattern 22. The illumination device 366 may be used in conjunction with the illumination device 200 such that the fiber 204 of the illumination device 200 is permitted to illuminate the center-aiming point 274.

Figure 32:
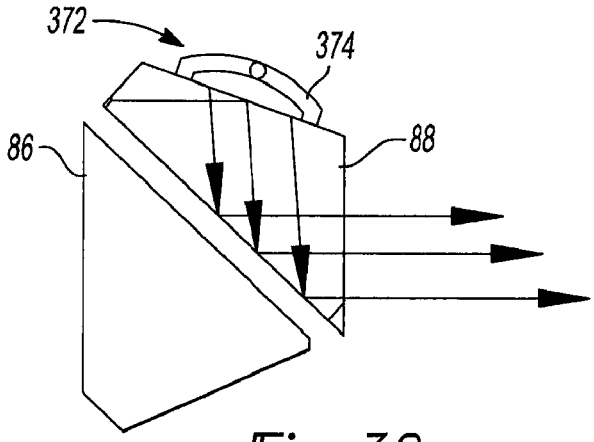
FIG. 32 is a cross-sectional view of a prism assembly and illumination device for use with the optical sight of FIG. 3 including a face mount LED with a wide-view angle for directing light towards the prism assembly.

With reference to FIG. 32, an illumination device 372 is provided and includes a surface-mount LED 374 including a wide-view angle that may be mounted to the mirror prism 88. Using the LED 374 having a wide-view angle allows the LED 374 to fully illuminate the reticle pattern 22. The illumination device 372 may be used in conjunction with the illumination device 200 to allow the fiber 204 of the illumination device 200 to illuminate the center-aiming point 274.

Figure 33:
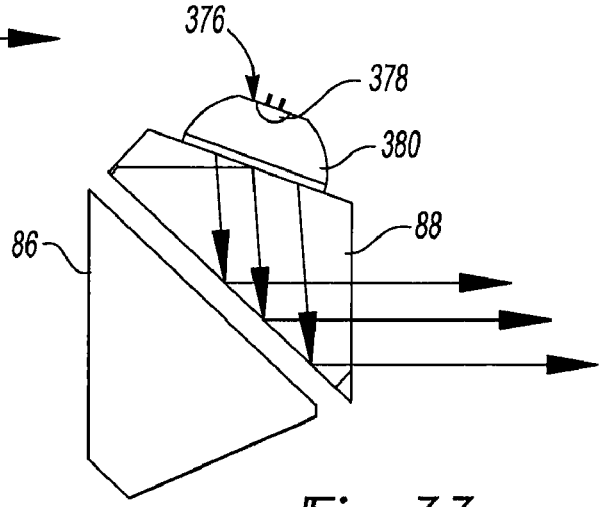
FIG. 33 is a cross-sectional view of a prism assembly and illumination device for use with the optical sight of FIG. 3 including an optic lens and an LED.

With reference to FIG. 33, an illumination device 376 is provided and includes an LED 378 mounted to a clear lens 380. The lens 380 may be mounted to the mirror prism 88 and may direct light from the LED 378 generally towards the mirror prism 88. Directing light towards the mirror prism 88 allows the LED 378 and lens 380 to fully illuminate the reticle pattern 22 including the stadia lines 272 and center-aiming point 274. The illumination device 376 may be used in conjunction with the illumination device 200 such that the fiber 204 of the illumination device 200 is permitted to illuminate the center-aiming point 274.

Figure 34:
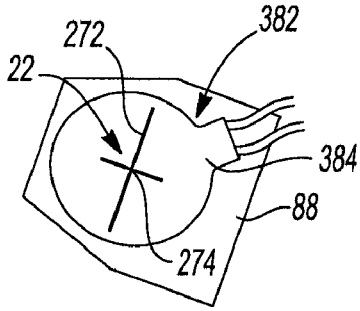
FIG. 34 is a top view of a prism assembly and illumination device for use with the optical sight of FIG. 3 including an electroluminescent flat-film lamp.
Figure 35:
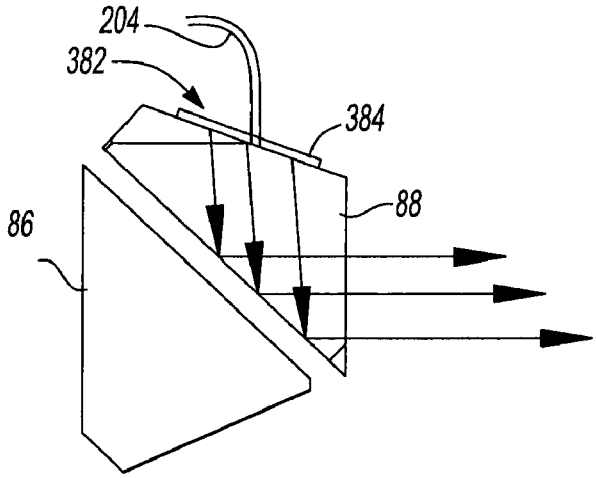
FIG. 35 is a cross-sectional view of the prism assembly and illumination device of FIG. 34 with an optical fiber.

With reference to FIGS. 34 and 35, an illumination device 382 is provided and includes an optical device 384 mounted to the mirror prism 88. The optical device 384 may be a circular die cut electroluminescent flat-film lamp glued with optical glue to a face of the mirror prism 88. The optical device 384 distributes light evenly with a variation of colors across the reticle pattern 22. The illumination device 382 may be used in conjunction with the illumination device 200 such that the fiber 204 of the illumination device 200 is permitted to illuminate the center-aiming point 274.

Figure 36:
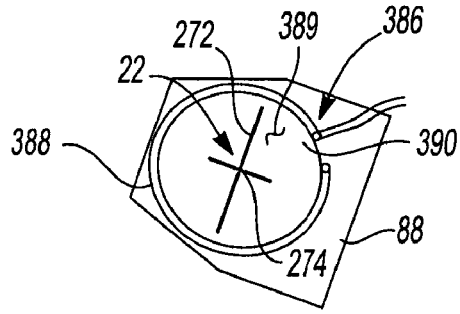
FIG. 36 is a top view of a prism assembly and illumination device for use with the optical sight of FIG. 3 including an electroluminescent wire lamp disposed around a glass diffuser.
Figure 37:
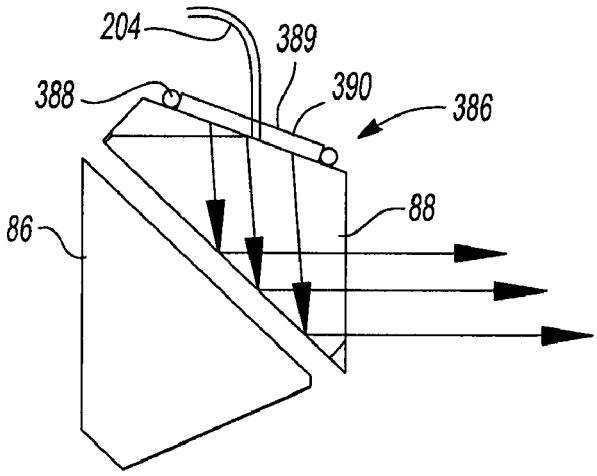
FIG. 37 is a cross-sectional view of the prism assembly and illumination device of FIG. 36 with an optical fiber.

With reference to FIGS. 36 and 37, an illumination device 386 is provided and includes an electroluminescent wire lamp 388 and an optical device 390. The optical device 390 may be a glass diffuser that is attached to the mirror prism 88 and may receive light from the electroluminescent wire lamp 388 to direct light from the electroluminescent wire lamp 388 toward the reticle pattern 22. The glass diffuser may include a mirrored top surface 389 that evenly disperses light emitted from the electroluminescent wire lamp 388 and may include outside surfaces that are painted with a reflective coating to aid in internal reflectivity of the optical device 390. The illumination device 386 may be used in conjunction with the illumination device 200 to allow the fiber 204 of the illumination device 200 to directly illuminate the center-aiming point 274.

Figure 38:
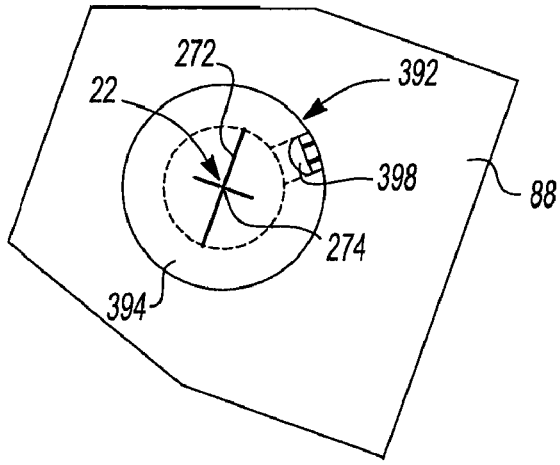
FIG. 38 is a top view of a prism assembly and illumination device for use with the optical sight of FIG. 3 including an aluminum circular mold, an optical fiber, ultraviolet glue and an LED.
Figure 39:
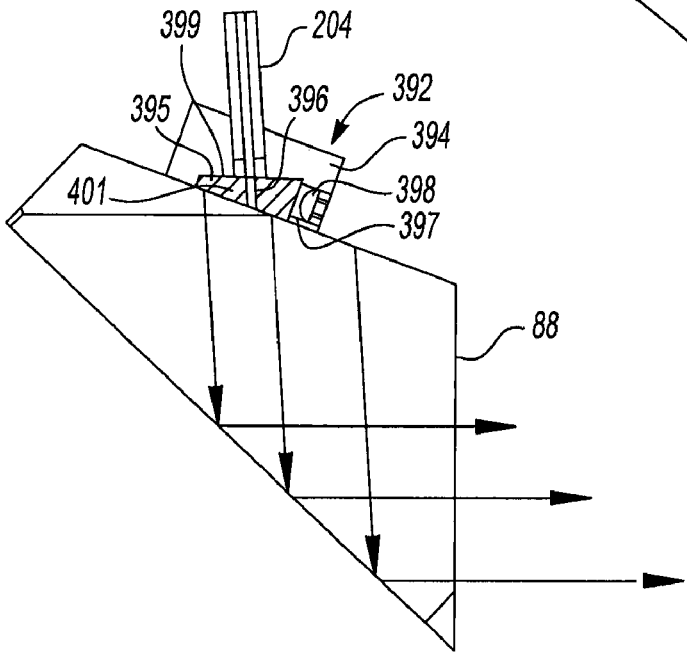
FIG. 39 is a cross-sectional view of a prism assembly and illumination device for use with the optical sight of FIG. 3 including an aluminum mold having a polished core, an optical fiber and an LED directing light towards the prism assembly via the aluminum mold.

With reference to FIGS. 38 and 39, an illumination device 392 is provided and includes a molded aluminum circular block 394 mounted to the mirror prism 88. The machined/molded block 394 has a recess 395, which is either polished or painted with a reflective coating. An LED 398 is inserted in a hole drilled at a side of the machined/molded block 394. Light from the LED 398 is directed to the recess 395 of the machined/molded block 394 through a channel 397 and is reflected off a polished or painted surface 399 of the machined/molded block 394 and directed generally to the reticle pattern 22 to illuminate the stadia lines 272. The illumination device 392 may further include an ultraviolet glue 401 disposed within the recess 395 to aid in dispersing light emitted from the LED 398 and fiber 204 generally towards the reticle pattern 22.

The illumination device 392 may be used in conjunction with the illumination device 200 such that the fiber 204 of the illumination device 200 is permitted to illuminate the center-aiming point 274. If the illumination device 392 is used in conjunction with the illumination device 200, one end of the jacket fiber 204 may be stripped to reveal a clear fiber 396. The clear fiber 396 may extend through the aluminum circular mold 394 to direct light from the fiber 204 of the illumination device 200 toward the center-aiming point 274. The clear fiber 396 may be painted with an opaque coating or a reflective coating to prevent light from clear fiber 396 being diffused into the ultraviolet glue 401.

Figure 6:
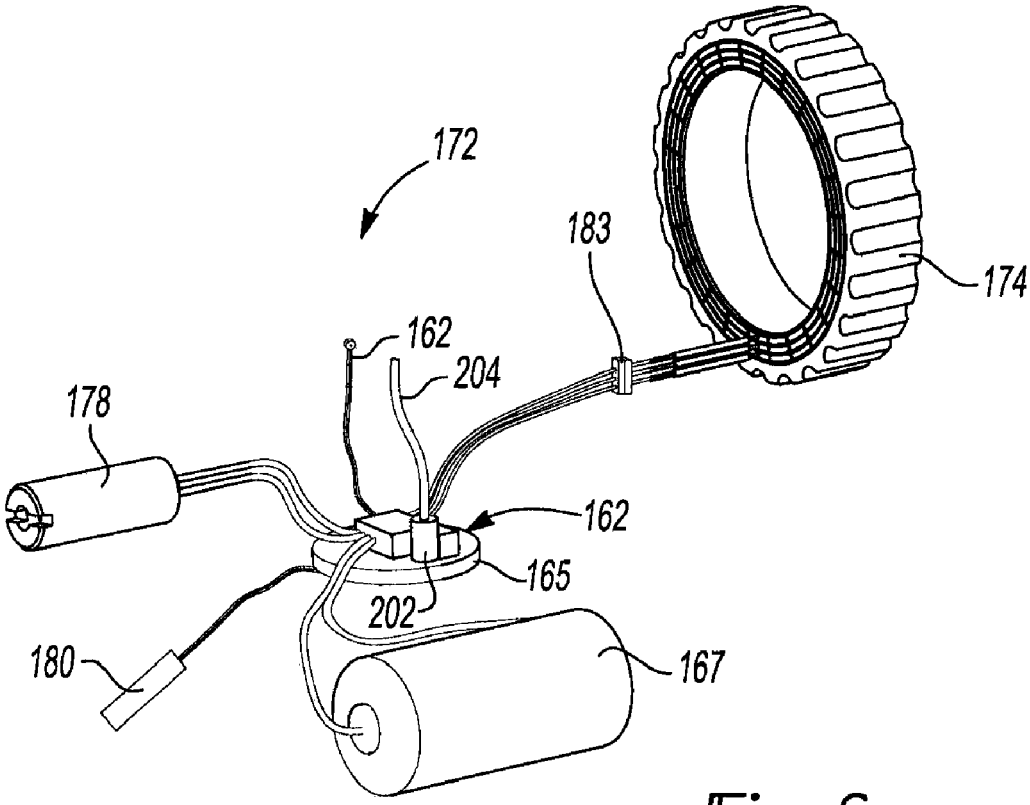
FIG. 6 is a perspective view of a control system for use with the optical sight of FIG. 1.

With reference to FIG. 6, a control system 172 for use with the illumination system 18 is provided and includes a rotary switch, sleeve, or dial 174, a power source such as the battery 167, and a photo sensor and/or photodiode 178. The control system 172 may be in communication with the rotary device 174, which may include a plurality of positions that allow a user to control operation of the illumination system 18 by rotating the rotary device 174 relative to the housing 12. For example, the rotary device 174 may be moved into a position such that the illumination device 18 supplies light to the reticle pattern 22 solely by the fluorescent fiber 152 (i.e., the rotary device 174 is in an "OFF" position). Alternatively, the rotary device 174 may be positioned such that light is supplied to the reticle pattern 22 via the fluorescent fiber 152 in conjunction with the LED 162 using any of the configurations shown in FIGS. 7-39. The photo sensor and/or photodiode 178 may be used to automatically adjust an amount of light supplied to the reticle pattern 22 based on environmental conditions in which the optical gun sight 10 is used, and may also be assigned a position on the rotary device 174. The rotary device 174 may be positioned in any of the positions to allow a user to select between use of the LED 162, Tritium lamp 164, photo sensor and/or photodiode 178, and the OFF position, which limits light supplied to the reticle pattern 22 to only that which is supplied by the fluorescent fiber 152.

The battery 167 may be in communication with the LED 162 and/or photo sensor and/or photodiode 178. The battery 167 may supply the LED 162 and photo sensor and/or photodiode 178 with power. If the battery 167 is depleted, the Tritium lamp 164 may be used in conjunction with the fluorescent fiber 152 to illuminate the reticle 22. If the battery 167 is low, the control system 172 may blink a predetermined number of pulses on an initial start of the control system 172 to notify a user of the low-battery condition.

The control system 172 may also include a tape switch 180 that is an on/off switch that allows a user to control the illumination system 18. The tape switch 180 may be in communication with the control system 172 such that when the tape switch 180 is in an "ON" position, the control system 172 supplies the reticle pattern 22 with an amount of light in accordance with the position of the rotary device 174. For example, if the rotary device 174 is in a position whereby the LED 162 supplies light to the reticle pattern 22 in conjunction with the fluorescent fiber 152, turning the tape switch 180 to the ON position illuminates the reticle pattern 22 using the LED 162 and fluorescent fiber 152. Depressing the tape switch 180 into the OFF position shuts down the control system 172 and limits the light supplied to the reticle pattern 22 to only that which is supplied by the fluorescent fiber 152 and the Tritium lamp 164.

The rotary device 174 may include a pulse width modulated circuit and/or a resistive system associated with various settings of the rotary device 174. For example, when the rotary device 174 is positioned to use pulse width modulated (PWM) control, a PWM signal is supplied to the LED 162 to control the amount of light supplied by the LED 162 between 0% and 100% of a total illumination of the LED 162, depending on the signal supplied by the control system 172 to the LED 162. For example, the rotary device 174 may include five different PWM settings, whereby each setting increases the PWM signal supplied to the LED 162 by 20%. As the rotary device 174 is rotated between the various positions, the intensity of the LED 162 is increased and the illumination of the reticle pattern 22 is similarly increased.

In addition to using PWM control, the rotary device 174 may include a resistive, hall effect, reed switch, or magnetic switch system, whereby as the rotary device 174 is rotated relative to the housing 12, the illumination of the LED 162 is directly modulated and increased/decreased. Controlling the illumination of the LED 162 in such a fashion allows for infinite control of the LED 162 and therefore allows the reticle pattern 22 to be illuminated virtually at any level of illumination.

Figure 40:
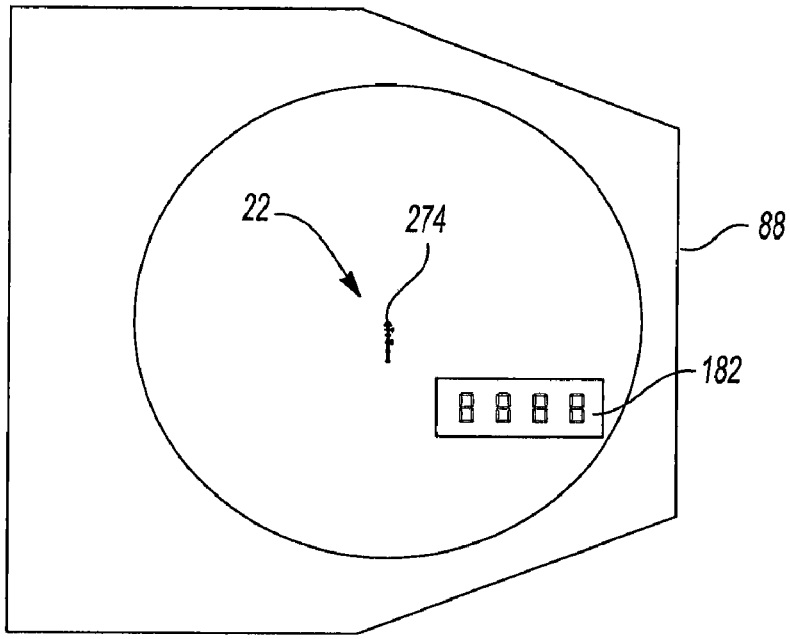
FIG. 40 depicts a reticle pattern of the optical sight of FIG. 3 including a display.
Figure 41:
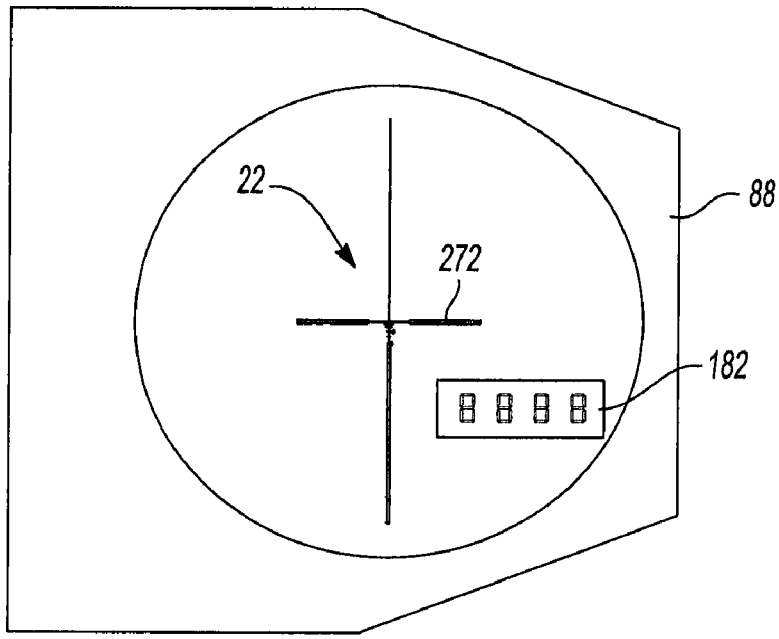
FIG. 41 depicts a reticle pattern of the optical sight of FIG. 3 including a display.

With reference to FIGS. 40 and 41, the reticle 22 is shown in conjunction with a display 182. The display 182 may be in communication with the control system 172 and may receive instructions from the control system 172. The data display 182 may be used in conjunction with any of the foregoing illumination devices 200, 210, 211, 224, 240, 256 and/or any of the illumination devices shown in FIGS. 12-39. The control system 172 may supply the display 182 with data such as, for example, coordinates, range, text messages, and/or target-identification information such that a user may see the information displayed adjacent to the reticle 22. If the display 182 provides information relating to range, the optical sight 10 may also include a range finder (not shown) that provides such information. The display 182 may include an LED, a seven-segment display, or a liquid-crystal display (LCD) or any other digital ocular device for use in transmitting an image to the use of the optical gun sight 10.

The display 182 may be formed by removing a coating from a surface of the prism 88. For example, Aluminum may be removed from a surface of the prism to allow light to pass through the prism 88 where the material is removed—an exposed region. The exposed region may be coated with a dichroic coating to allow most ambient light to pass therethrough while restricting a predetermined color from passing through. For example, if information is displayed on the prism 88 in red, the dichroic coating would allow colors with wavelengths different than red to pass through the prism 88 to allow a user to see through the optical sight 10 even in the exposed region. If data is displayed in red, and red it not permitted to pass through the dichroic coating, the data may be displayed and viewed in the exposed region.

External inputs or ports may be included on the housing 12 of the optical gun sight 10. For example, inputs or ports could be USB, firewire, Ethernet, wireless, infrared, rapid files, or any custom connection to allow a secondary or tertiary piece of equipment to communicate and display various information on the display 182. Such secondary pieces of equipment could be a laser-range finder, night-vision scope, thermal-imaging system, GPS, digital compass, wireless satellite uplink, military unit communication link, or friend/foe signal or auxiliary power supply.

A pair of elastomeric electric contact connectors 183 may also be supplied to provide power from the battery 167 and communication from the control module 165 to the rotary device 174, and may allow communication of illumination setting signals from the rotary device 174 to the control module 165, which will control LED 162. The above configuration allows for a solid electrical connection between the eyepiece 64 and body 42 without the need to route wires between sealed mechanical separation points of the optical sight 10, the eyepiece 64, and the body 42.

What is claimed is:

1. An optical sight comprising:

a housing;

at least one optic supported by said housing;

a fiber supported by said housing and selectively supplying light to said at least one optic; and a sleeve supported by said housing and including an opening that selectively exposes said fiber to vary an amount of light supplied to said at least one optic and a cover extending across said opening and movable with said sleeve relative to said fiber.

2. The optical sight of claim 1, wherein said cover is spaced apart from said fiber.

3. The optical sight of claim 1, wherein said cover is formed from one of a transparent material or a translucent material to allow light to pass therethrough.

4. The optical sight of claim 1, wherein said fiber is wrapped around said housing.

5. The optical sight of claim 1, wherein said fiber is wrapped around an entire perimeter of said housing.

6. The optical sight of claim 1, wherein said sleeve includes a body that may be positioned over said fiber to prevent light from reaching said fiber.

7. The optical sight of claim 1, wherein said fiber includes a first portion having a coating that prevents light from being collected at said first portion and a second portion that is exposed to allow said fiber to collect light at said second portion.

8. The optical sight of claim 7, wherein said sleeve is rotatable relative to said housing to selectively position said opening over said first portion to prevent said fiber from collecting light and to selectively position said opening over said second portion to prevent said fiber from collecting light.

9. The optical sight of claim 7, wherein said sleeve is rotatable relative to said housing to selectively position said opening over at least one of said first portion and said second portion to adjust an amount of light collected by said fiber.

10. The optical sight of claim 1, wherein said at least one optic is a prism.

11. The optical sight of claim 10, wherein said prism includes pattern formed on surface thereof and selectively illuminated by said fiber.

12. The optical sight of claim 1, further comprising a seal associated with said cover to prevent intrusion of debris between said cover and said sleeve.

13. The optical sight of claim 12, wherein said seal is a hermetic seal.

14. The optical sight of claim 1, further comprising a series of projections formed on said sleeve to facilitate movement of said sleeve relative to said housing.

15. An optical sight comprising:

a housing;

at least one optic supported by said housing;

a fiber supported by said housing and selectively supplying light to said at least one optic, said fiber being wrapped around an entire perimeter of said housing; and a sleeve supported by said housing and including an opening that selectively exposes said fiber to vary an amount of light supplied to said at least one optic and a cover extending across said opening and spaced apart from said fiber to permit movement of said cover relative to said fiber.

16. The optical sight of claim 15, wherein said cover is formed from one of a transparent material or a translucent material to allow light to pass therethrough.

17. The optical sight of claim 15, wherein said sleeve includes a body that may be positioned over said fiber to prevent light from reaching said fiber.

18. The optical sight of claim 15, wherein said fiber includes a first portion having a coating that prevents light from being collected at said first portion and a second portion that is exposed to allow said fiber to collect light at said second portion.

19. The optical sight of claim 18, wherein said sleeve is rotatable relative to said housing to selectively position said opening over said first portion to prevent said fiber from collecting light and to selectively position said opening over said second portion to prevent said fiber from collecting light.

20. The optical sight of claim 18, wherein said sleeve is rotatable relative to said housing to selectively position said opening over at least one of said first portion and said second portion to adjust an amount of light collected by said fiber.

21. The optical sight of claim 15, wherein said at least one optic is a prism.

22. The optical sight of claim 21, wherein said prism includes pattern formed on surface thereof and selectively illuminated by said fiber.

23. The optical sight of claim 15, further comprising a seal associated with said cover to prevent intrusion of debris between said cover and said sleeve.

24. The optical sight of claim 23, wherein said seal is a hermetic seal.

25. The optical sight of claim 15, further comprising a series of projections formed on said sleeve to facilitate movement of said sleeve relative to said housing.

* * * * *

UNITED STATES PATENT AND TRADEMARK OFFICE

CERTIFICATE OF CORRECTION

PATENT NO. : 7,676,137 B2
APPLICATION NO. : 12/125367
DATED : March 9, 2010
INVENTOR(S) : Darin W. Schick et al.

It is certified that error appears in the above-identified patent and that said Letters Patent is hereby corrected as shown below:

Column 6, Line 4, "convex-piano" should be --convex-plano--.

Column 6, Line 6, "convex-piano" should be --convex-plano--.

Column 6, Line 13, "concave-piano" should be --concave-plano--.

Column 7, Line 6, "convex-piano" should be --convex-plano--.

Column 7, Line 6, "concave-piano" should be --concave-plano--.

Column 19, Line 9, "piano-concave" should be --plano-concave--.

Column 19, Lines 17-18, "piano-concave" should be --plano-concave--.

Signed and Sealed this

Twenty-seventh Day of July, 2010

David J. Kappos

David J. Kappos
*Director of the United States Patent and Trademark Office*